US005708932A

United States Patent [19]

Yano et al.

[11] Patent Number: 5,708,932

[45] Date of Patent: Jan. 13, 1998

[54] CHARGING SYSTEM AND ELECTROPHOTOGRAPHY APPARATUS

[75] Inventors: Hideyuki Yano, Yokohama; Akio Maruyama, Tokyo; Yomishi Toshida, Yokohama; Noboru Kashimura, Tokyo; Kazushige Nakamura, Yokohama; Shoji Amamiya, Kawasaki; Harumi Ishiyama, Yokohama; Tadashi Furuya, Kawasaki, all of Japan

[73] Assignee: Canon Kabushiki Kaisha, Tokyo, Japan

[21] Appl. No.: 779,389

[22] Filed: Jan. 7, 1997

Related U.S. Application Data

[63] Continuation of Ser. No. 359,744, Dec. 30, 1994, abandoned.

[30] Foreign Application Priority Data

| | | | |
|---|---|---|---|
| May 19, 1994 | [JP] | Japan | 6-129706 |
| Jun. 22, 1994 | [JP] | Japan | 6-140207 |
| Dec. 14, 1994 | [JP] | Japan | 6-310548 |

[51] Int. Cl.[6] ..... G03G 15/00

[52] U.S. Cl. ..... 399/159; 399/175

[58] Field of Search ..... 399/130, 159, 399/168, 174, 175, 176; 361/225; 430/56, 66

[56] References Cited

U.S. PATENT DOCUMENTS

| | | | |
|---|---|---|---|
| 4,359,514 | 11/1982 | Shimizu et al. . | |
| 4,649,094 | 3/1987 | Tamura et al. | 430/126 |
| 4,962,008 | 10/1990 | Kimura et al. | 430/66 |
| 4,990,418 | 2/1991 | Mukoh et al. | 430/56 |
| 5,138,387 | 8/1992 | Sato et al. . | |
| 5,172,163 | 12/1992 | Yamaoki et al. . | |
| 5,357,323 | 10/1994 | Hameda et al. . | |
| 5,426,488 | 6/1995 | Hayakawa et al. . | |

FOREIGN PATENT DOCUMENTS

| | | |
|---|---|---|
| 58-98746 | 6/1983 | Japan . |
| 60-022145 | 2/1985 | Japan . |
| 60-22145 | 2/1985 | Japan . |
| 61-148468 | 7/1986 | Japan . |
| 2-085863 | 3/1990 | Japan . |
| 4-107566 | 4/1992 | Japan . |
| 4-142566 | 5/1992 | Japan . |
| 5-257315 | 10/1993 | Japan . |

*Primary Examiner*—Sandra L. Brase

*Attorney, Agent, or Firm*—Fitzpatrick, Cella, Harper & Scinto

[57] ABSTRACT

This invention relates to a charging system for charging a body to be electrified, comprising a body to be electrified, and a charging member which can be applied with voltage to brush the surface of said body to be electrified and charge it. Wherein the surface of the body to be electrified exhibits a contact angle of 90° or more for water.

23 Claims, 7 Drawing Sheets

CHARGING SYSTEM AND ELECTROPHOTOGRAPHY APPARATUS

This application is a continuation of application Ser. No. 08/359,744 filed Dec. 30, 1994, now abandoned.

BACKGROUND OF THE INVENTION

1. Field of the Invention

The present invention relates to a charging system for electrifying (including clearing) a body to be electrified, such as a photosensitive body or a dielectric body, by keeping the body to be electrified in contact with a charging member to which voltage can be applied, and to an electrophotography apparatus for performing such electrification. This charging system can be applied to an image forming apparatus and a process cartridge which is detachably mounted on an image forming apparatus.

2. Related Background Art

As a means for charging an image supporter such as a photosensitive body, a dielectric body, and so on, and other kind of bodies to be electrified, a corona charging device has been generally used, for example, in an electrophotography apparatus (copying machine, printer, and the like) and an image forming apparatus such as an electrostatic recording apparatus. Such a corona charging device performs electrification by applying high voltage to wire to cause corona discharge and exposing a body to be charged to the corona. Recently, more and more charging devices of contact electrification type have been employed. Such a charging device performs electrification by keeping a charging member in contact with a body to be electrified and applying voltage to the charging member.

Compared with the corona charging technique, the contact charging technique has some merits. That is, the voltage applied to give a desired potential to the surface of the body to be electrified can be reduced (low electric power), the amount of ozone generated in the charging process can be reduced (small amount of ozone), and so on. Among charging devises of contact electrification type, those of roller charging type, which are conductive rollers as the charging members, have been widely used because charging process of this kind of devices is stable.

In a charging device of roller charging type, when the charging roller applied with DC voltage is driven, that is, passively rotated by a photosensitive body or the body to be electrified, non-uniformity in the charged body occurs, because irregularity in the surface of the roller causes non-uniformity in contact condition as well as there is non-uniformity in resistance of the roller. Therefore, it is preferable to make a difference between the speed at which the charging member is rotated and that of the body to be electrified so that the body to be electrified is rubbed against the charging member.

In the charging apparatus of contact electrification type employing the above counter measure, however, large frictional force caused between the surface of the body to be electrified and the charging member causes the following problems.

(a) If a charged brush is used as the contact charging member, there occurs a space between bristles 2, as shown in FIG. 4B. As a result, part of the surface of the body to be electrified can not come into contact with the charging member, which causes non-uniformity in the charged surface.

(b) If a magnetic brush is used as the contact charging member, smooth movement of magnetic particle in a nip is hindered, which causes non-uniformity in the contact nip. In this case, the surface of the body to be electrified can not.be charged uniformly. In addition, the electric charge filling performance is reduced because the chances for the magnetic particles to come into contact with the body to be electrified become less.

(c) Since the torque required to rotate the contact charging member is large, the contact charging member can not be uniformly rotated. This non-uniformity in rotation causes non-uniformity in the charged surface of the body to be electrified, as well as, in the case of an image forming apparatus, causes non-uniformity in an image.

(d) If a charged brush is used as the contact charging member, the end portion of the piles of the brush suffer from abrasion after long-term use. In this case, the electric charge filling performance is reduced, which causes non-uniformity in the charged surface of the body to be electrified, as well as, in the case of an image forming apparatus, causes non-uniformity in an image.

On the other hand, several methods have been proposed, in which a plurality of processes such as electrification, exposure, development, and so on are combined to be executed at the same time and substantially at the same position. Typical methods among then are disclosed in Japanese Patent Laid-Open Application Nos. 58-98746, 60-22145, and so on. According to these method, conductive toner or a combination of conductive carrier and insularlye toner is generally used. And (1) a cleaning process for removing residual toner which was used for the previous image formation and still remains after transfer process, (2) a contact electrification process, (3) an image exposure process for exposing the back surface of the photosensitive body to light, and a contact development process are executed in sequence. These processes are executed in the contact nip between the surface of the photosensitive body corresponding to the back surface exposure position and a magnetic brush roller facing thereto. The back surface exposure technique employed in an image forming apparatus will be described below.

As shown in FIG. 8, a magnetic brush provided on the developer sleeve 3*b* and a photosensitive body 1 positioned in contact with each other form a nip area N. On the upstream side in this nip, the cleaning process is carried out, wherein the residual toner after transfer process is scraped off. Since the toner employed is magnetic toner and a magnet roll is provided inside the sleeve, the cleaning effect can be increased by the magnetic brush. Next, the charging process is performed, wherein the surface of the photosensitive body is brushed by the conductive magnetic brush in the nip area N to be electrically charged and given a predetermined potential.

In order to achieve the above process, the photosensitive body has to be made of materials which make it possible to hold electric charge near the surface of the. photosensitive body. More specifically, the photosensitive body may be made of amorphous silicon (hereinafter referred as a-Si) while having its surface coated with an inhibiting layer in order to improve the electric charge filling performance, or may be an OPC photosensitive body. Otherwise, a photosensitive body provided with a surface layer in which conductive particles are dispersed may be also employed.

In the next process, an exposure beam is given to the back surface of the photosensitive body, the opposite side with respect to the magnetic brush which comes into contact with the photosensitive body. As a light source, digital light emitting elements such as an LED array is used. A predetermined position in the nip between the developer sleeve and the photosensitive body is exposed to the light beam.

After a latent image is formed in the exposure process, the development process is executed in a developing area, which is downstream in the nip area N. When conductive toner is used, electric charge is transmitted through the bristles of the toner to the toner at the end portions of the bristles by the electrostatic induction of the latent image formed on the photosensitive body. Then, the toner at the end portions of the bristles is separated from the bristles by the Coulomb force acting between the electric charge of the toner and that of the latent image, carrying out development.

When two-component developer consisting of magnetic conductive carrier and insulative toner is used in the same construction, the bristles of the conductive carrier serve as closely positioned electrodes. In this case, since a sufficient electric field can be given even by applying a low voltage between the photosensitive body and the developer sleeve, development with the insularlye toner can be performed by applying a low voltage.

In the above-mentioned back surface exposure technique, contact electrification using the magnetic brush roller is used. Accordingly, like in the charging apparatus as described before which only performs electrification, non-uniformity of contact condition of the brush roller causes non-uniformity of electrification, which results in a defective image. In order to solve this problem, also in the above apparatus of back surface exposure type, it is preferable to make a difference between the circumferential speed of the charging member (also serving as the developer member) and that of the photosensitive body and reduce a bad influence from non-uniformity of electrification.

The back surface exposure technique also has its own problems to be solved because many processes are performed within the narrow nip area N between the photosensitive body and the developer sleeve. One of the most serious problems is poor charge. Since it is difficult to give a desired potential to the surface of the photosensitive body, the photosensitive body may sometimes be poorly and non-uniformly charged. According to the back surface exposure technique, as shown in FIG. 9, reverse development is performed, wherein the charged potential easily becomes the same as or lower than the developing bias potential. Accordingly, even slightly poor charge may cause fogging (a phenomenon in which toner dimly adheres the background of an image) and a ghost image of the previously formed image.

For example, poor charge occurs when chances for the conductive carrier to come into direct contact with the photosensitive body to fill the photosensitive body with electric charge become less, or when the length of the contact nip is not uniform, or when the resistance of the developer increases for some reason.

According to the back surface exposure technique, the residual toner which was not transferred onto the transfer medium but still remains is cleaned substantially at the same time that the photosensitive body is charged, and in the narrow nip area. As a result, it may happen that the electrification process starts before the residual toner remaining after transfer process has not yet completely cleaned, or that there is not sufficient time to complete the electrification process. In these cases, since the residual toner hinders electrification, the potential of the previously formed image can not be completely erased and poor charge may often cause a positive ghost image.

SUMMARY OF THE INVENTION

An object of the present invention is to provide a charging system for stably keeping a charging member in contact with a body to be electrified in order to realize uniform electrification, and an electrophotography apparatus for performing such electrification.

Another object of the present invention is to provide a charging system which can reduce torque required to drive a charging member, and an electrophotography apparatus employing such a charging system.

Another object of the present invention is to provide a charging system which can prevent abrasion of a charging member even after long-term use, and an electrophotography apparatus employing such a charging system.

Another object of the present invention is to provide an electrophotography apparatus which can prevent poor charge and a ghost image, stabilize a nip formed between a photosensitive body and a magnetic brush, and realize smooth movement of developer in the nip.

The other objects as well as characteristics of the present invention will be clearly understood by reading the following detailed description with reference to the accompanied drawings.

DETAILED DESCRIPTION OF THE PREFERRED EMBODIMENTS

Now, preferred embodiments according to the present invention will be described with reference to the accompanied drawings.

<First Embodiment> (FIGS. 1 to 4A and 4B)

An image forming apparatus of this embodiment employing a charging system in which the circumferential speed of a primary charger device for charging an image supporter is different from that of the image supporter. And the image forming apparatus of this embodiment is further characterized as a laser beam printer performing transfer electrophotography processes.

(1) Outline of General Construction of the Image Forming Apparatus.

Figure 1:
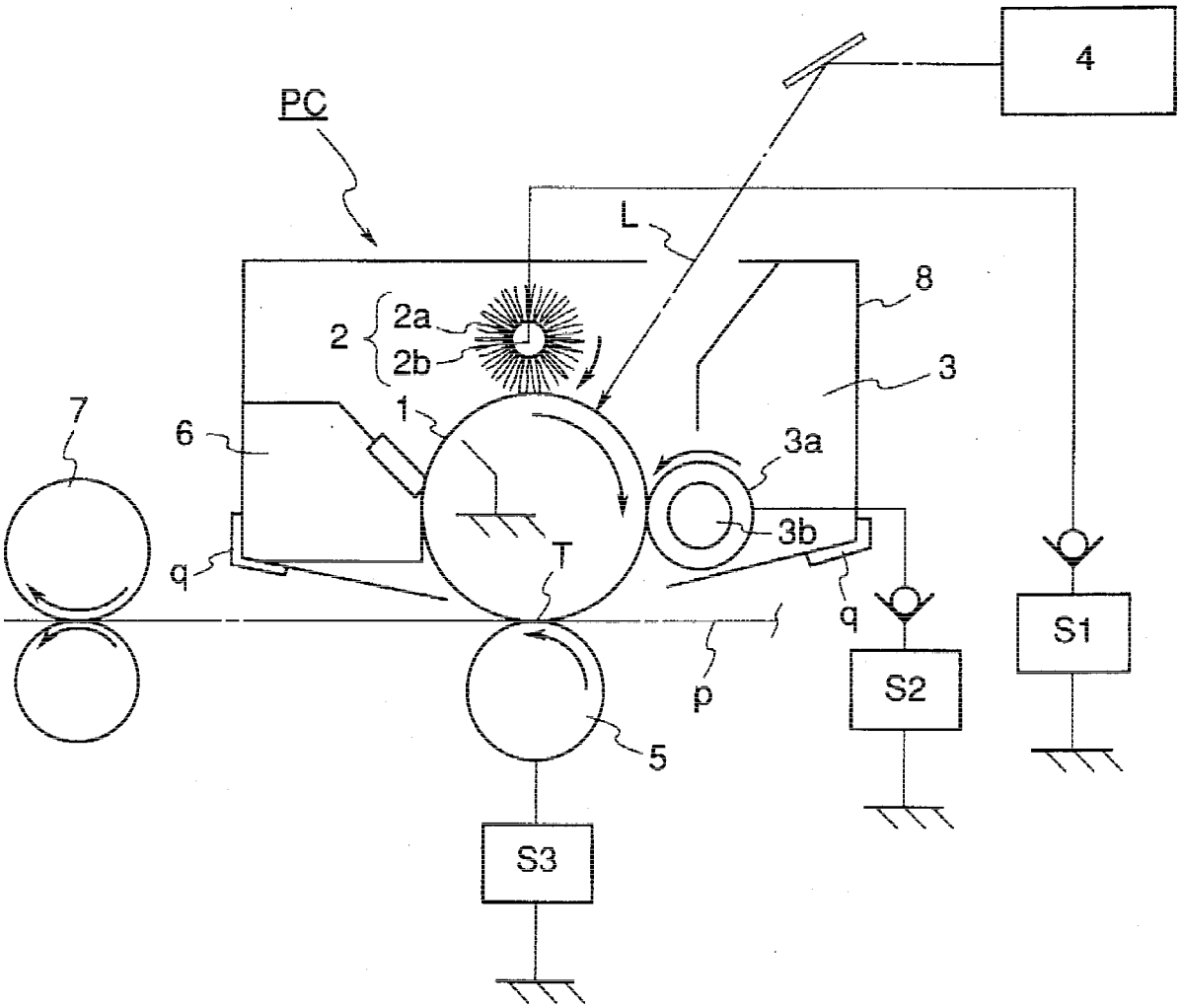
FIG. 1 is a schematic view of the apparatus of the first embodiment according to the present invention.

In FIG. 1, a reference numeral 1 designate an electrophotography photosensitive body serving as a image supporter (a body to be electrified). This photosensitive body 1 is a rotating drum made of OPC photosensitive material, and has a diameter of 30 mm. The photosensitive body 1 is rotated at a process speed (circumferential speed) of 100 mm/sec clockwise, as indicated by an arrow in FIG. 1. A charged brush 2 serving as a contact charging member is positioned in contact with the photosensitive body 1 so that the contact area may have a width of 3 mm. The charged brush 2 is rotated in the direction opposite to the photosensitive body 1 in the contact area at 500 rpm (circumferential speed of 314 mm/sec), and is charged with DC charging bias voltage of −700 V by a power source S1 for applying charging bias. Accordingly, the outer peripheral surface of the rotating photosensitive body 1 is uniformly charged with voltage of about −700V.

The charged surface of the rotating photosensitive body 1 is subjected to scan exposure L with laser beams whose intensities are modulated on the basis of time-series electric digital signals according to data of a desired image. These laser beams are emitted from a laser beam scanner 4 comprising a laser diode polygonal mirror, and so on. Thus, an electrostatic latent image corresponding to the data of a desired image is formed on the peripheral surface of the rotating photosensitive body 1. The electrostatic latent image is developed to an toner image by a reverse developer apparatus 3 using a one-content magnetic insulative toner. A non-magnetic developer sleeve 3*a* having a diameter of 16 mm which contains a magnet 3*b* is coated with said negative toner, and fixed close to the surface of the photosensitive body 1 with a distance of 300 μm. While the photosensitive body 1 and the developer sleeve 3*a* are rotated at the same speed, the developer sleeve 3*a* is applied with developing bias voltage by a power source S2 for applying developing bias. The developing bias voltage is obtained by superimposing a rectangular AC voltage having a frequency of 1800 Hz and a peak plateau voltage of 1600 V on a DC voltage of −500 V. With this developing bias voltage, the jumping development is executed between the developer sleeve 3*a* and the photosensitive body 1.

On the other hand, a transfer medium P serving as a recording medium is conveyed from a sheet feed unit (not shown), and inserted, at predetermined timing, in a pressure contact nip (transfer position) T between the rotating photosensitive body 1 and a transfer roller 5 serving as a contact transfer means. The transfer roller 5 has a medium resistance and is pressed against the rotating photosensitive body 1 so as to obtain a predetermined value of contact pressure. A power source S3 for applying transferring bias applies a transferring bias of a predetermined value to the transfer roller 5. In this embodiment, the transfer roller 5 has a resistance of $5\times10^8$ Ω, and the transfer process is carried out by applying a DC voltage of +2000 V.

As the transfer medium P inserted into the transfer position T is pinched and carried through the transfer position T, the toner image formed and supported on the surface of the rotating photosensitive body 1 is gradually transferred onto the surface of the transfer medium P by electrostatic attraction and contact pressure. The transfer medium P on which the toner image has been transferred is separated from the surface of the photosensitive body 1 and carried to a fixing device 7 of, for example, thermal fixture type, where the toner image is fixed. After that, the transfer medium P is discharged out of the apparatus as the medium (a print or a copy) on which the desired image has been formed. After the toner image is transferred onto the transfer medium P, the residual toner and other unnecessary things on the surface of the photosensitive body 1 are removed by a cleaning device 6, and the cleaned surface of the photosensitive body 1 is repeatedly used for image formation.

In the present embodiment, a cartridge PC comprises four processing device: the photosensitive body 1, the contact electrification member 2, the developer device 3, and the cleaning device 6, all in a cartridge box member 8. And this cartridge is detachably mounted on the apparatus. However, all these devices, need not be designed as a unit. Any modification can be employed as long as the cartridge is provided, at least, with the photosensitive body and the charging member. In the drawing, a reference numeral 9 designates supporting members for supporting the mounted processing cartridge PC. The power sources S1 and S2 are provided in the main body of the image forming apparatus, and are connected with the charging member and the developer sleeve, respectively, when the cartridge is mounted on the main body of the image forming apparatus.

(2) Structure of Photosensitive Body 1

Figure 2:
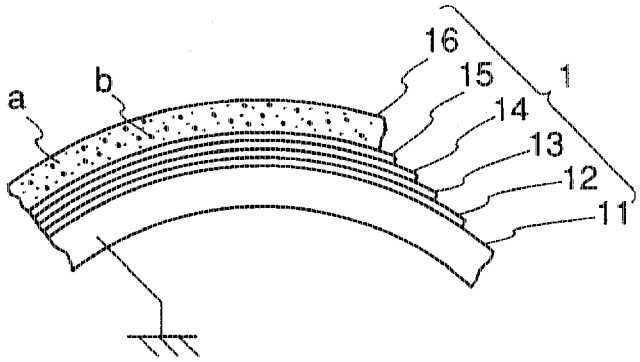
FIG. 2 is a cross-sectional view showing a model of the layer structure of a photosensitive body.

FIG. 2 schematically shows the layer structure of the photosensitive body 1. The photosensitive body 1 is a negatively chargeable OPC photosensitive body, which is prepared by coating an aluminum substrate drum 11 having a diameter of 30 mm with the following first to fifth functional layers 12 to 16 in the named order.

(i) The first layer is an under coat layer 12, which is a conductive layer and has a thickness of 20 μm. This under coat layer 12 levels the irregularity of the surface of the aluminum substrate drum 11 and prevents moires caused by the reflected laser beams used for the scan exposure L.

(ii) The second layer is an inhibiting layer 13 for preventing positive electric charge coming from the substrate drum 11 from canceling negative electric charge given to the surface of the photosensitive body 1. This inhibiting layer has a thickness of ca. 0.1 μm, and a medium resistance which is adjusted to be in the order of $10^6$ Ω by Amilan resin and methoxymethyl nylon.

(iii) The third layer is an electric charge generating layer 14 made of resin in which disazo pigment is dispersed. The thickness of this layer is about 0.3 μm. This layer 14 generates both positive and negative electric charge when exposed to the laser beams of scan exposure L.

(iv) The fourth layer is an electric charge carrying layer 15 made of polycarbonate resin in which hydrazone is dispersed. Accordingly, this layer 15 serves as a P-type semiconductor. The negative electric charge given to the surface of the photosensitive body 1 can not move through this layer 15, but only the positive electric charge generated in the electric charge generating layer 14 can be carried to the surface of the photosensitive body 1.

(v) The fifth layer is a surface layer 16 of the photosensitive body 1. This layer 16 is formed by coating the photosensitive body 1, on which the layers 12 to 15 have already been formed, with acrylic resin curable with light in which conductive ultra fine particles a of $SnO_2$ and fluororesin b such as teflon (a trade mark of DuPont Co., polytetrafluoroethylene (PTFE)) are dispersed. In this embodiment, the surface layer 16 was prepared by dispersing 60 volumes of acrylic monomer (20), 60 volumes of ultra fine particles of stannic oxide having a mean diameter of 400 Å, 50 volumes (26.3 wt %) of polytetrafluoroethylene fine particles (having a mean diameter of 0.18 μm), 20 volumes of 2-methylthioxanthone serving as photoinitiator, and 400 volumes of methanol in a sand mill for 48 hours.

According to the beam coating method, the resultant prepared mixture was applied on the electric charge carrying layer 15, and dried, and cured with light having an intensity of 8 mW/cm$^2$ emitted from a high voltage mercury lamp for 20 seconds. The thickness of the surface layer 16 was 3 μm. The prepared mixture for the surface layer 16 was well dispersed, and the surface of the surface layer 16 was uniformly formed. The volume resistivity of the surface layer 16 was in the order of $10^{13}$ Ω, which does not allow a blurred image caused by the drift of the electric charge of a latent image in the peripheral directions, but allows electric charge to move in the direction of the thickness of the layer in some degree. Thus, the residual potential after image exposure is minimized.

In the present embodiment, in order to reduce surface energy of the photosensitive body 1 and frictional force between the surface of the photosensitive body 1 and the charged brush 2, teflon particles b were dispersed in the binder.

Since the surface energy of teflon itself is very small, that is, about 20 dyne/cm, the surface energy of the photosensitive body could be remarkably reduced by dispersing teflon. While the contact angle of the surface of acrylic resin/stannic oxide, in which teflon is not dispersed, for water is 85°, the contact angle thereof when teflon is dispersed can be improved to be 95°.

In the present embodiment, since the surface layer 16 formed on the photosensitive body 1 is made of resin in which conductive material and lubricating material are dispersed, uniform contact filling of electric charge can be performed. In order to perform uniform contact filling of electric charge, the electric resistance of the surface layer itself, uniformity of dispersion of the conductive material and the lubricating material, transparency and strength of the surface layer have to be carefully controlled.

Preferably, the electric resistance of the surface layer 16 is adjusted in a range from $1\times10^{9}$ Ω·cm, under which the drift of electric charge causes a blurred image, to $1\times10^{14}$ Ω·cm, which is the maximum resistance allowing filling of electric charge.

Transparency of the surface layer 16 is determined by the transparency and particle diameters of the conductive material and the lubricating material. Preferably, diameters are 0.3 μm or less, for light should not be scattered. Most preferably, the diameters are 0.1 μm or less. The conductive material preferably used in the present embodiment is selected from conductive polymers such as poly(acetylene), poly(thiophene) and poly(pyrrole), and fine metal particles, and particles of metal oxides. In consideration of transparency, however, metal oxides and more preferable.

In addition to the above-mentioned stannic oxide, the conductive particles used in the present invention may also be selected from metals such as Cu, Al, Ni, and so on, zinc oxide, titanium oxide, antimony oxide, indium oxide, bismuth oxide, indium oxide in which stannum is doped, stannic oxide in which antimony is doped, zirconium oxide, and so on, all in the form of ultra fine particles. Each of these metal oxides may be used separately. Otherwise, two or more metal oxides may be combined, wherein they may be solid solution or be fused. The amount of the conductive fine particles contained in the surface layer 16 is determined according to, for example, their diameter. Preferably, the amount is determined in a range from 10 to 70 wt %.

The lubricating material is selected from graphite, wax having long chain alkyl group(s), compounds containing fluorine or silicon, and so on. Especially, compounds containing fluorine or silicone are preferable lubricating materials.

Examples of the compounds containing fluorine include, in addition to the above-mentioned polytetrafluoroethylene, copolymers such as tetrafluoroethylene, hexafluoropropylene, trifluoroethylene, chlorotrifluoroethylene, vinylidene fluoride, vinyl fluoride perfluoro alkyl-vinyl ether, and copolymers thereof. Other examples are carbon fluoride with fluorine atoms which has graphite structure, oils with fluorine atoms; and so on, wherein fluorine atoms are added by substitution. Further, inorganic fluorides may be used as the lubricating material.

Examples of the compounds containing silicone include monomethyl siloxane having third dimensional bridged structure, dimethylsiloxane-monomethyl-siloxane having third dimensional bridged structure, polydimethylsiloxane having a ultrahigh molecular weight, block polymers containing polydimethylsiloxane segments, graft polymers, surface active agents, macro monomer, polydimethylsiloxane with modified end groups, and so on.

The diameter of the lubricating material to be dispersed in the surface layer as particles is preferably 0.005 μm or more in order to exhibit sufficient lubricating effect, and preferably 0.3 μm or less in order to obtain a clear image without a blur and dimness.

The conductive material and the lubricating material are dispersed by a sand mill, a ball mill, a roller mill, a homogenizer, a nanomizer, a paint shaker, with ultrasonic wave, and so on. Auxiliary additives such as surface active agents, graft polymer, coupling agents may be added at the time of dispersion.

Sufficient strength of the surface layer 16 and excellent uniformity of dispersion of the conductive particles are especially important in the present embodiment. During the electrophotography processes, the surface layer 16 is subjected directly to the toner development, the cleaning operation, and other mechanical brushing operation. Especially, the surface layer of this embodiment in which the conductive particles are dispersed is formed as a thin film (of 0.5 to 5.0 μm. Therefore, sufficient strength against scraping and damage is required.

In order to exhibit a sufficient lubricating effect, the amount of the lubricating material contained in the surface layer should be 5 wt % or more. On the other hand, in order to obtain sufficient mechanical strength of the surface layer, the amount of the lubricating material is preferably 60 wt % or less. Non-uniformity in dispersion of the conductive particles causes non-uniformity of electrification, which further causes non-uniformity in the obtained image. Accordingly, the conductive particles have to be dispersed uniformly in the resin. In order to realize uniform dispersion, it is very effective to add coupling agents or treat the surfaces of the conductive particles with the coupling agents.

The above-mentioned two characteristics, that is, the strength of the surface layer and the uniformity in dispersion of the conductive particles are considerably varied by the resin used for the surface layer. The resin used for the surface layer of the present invention is selected from, in addition to the above-mentioned acrylic resin, polyester, polycarbonate, polyurethane, polystyrene, fluororesin, cellulose, vinyl chloride, epoxy resin, silicone resin, alkyl resin, vinyl chloride-vinyl acetate copolymer, and so on, all available on the market. According to the experiments on improvement of the strength and the uniformity of dispersion, a surface layer prepared as described below exhibited remarkable improvement of the strength of the layer and the uniformity of the dispersion of the conductive particles. That is, the conductive particles were dispersed in acrylic monomer which has three or more acryloyl groups per molecule and is curable with light. This resin including the conductive particles was applied on the photosensitive layer and cured with light.

If acrylic monomer which has two or more acryloyl groups per molecule and is curable with light is mixed with the above-mentioned polyester, polycarbonate, polyurethane, acrylic resin, epoxy resin, silicone resin, alkyd resin, vinyl chloride-vinyl acetate copolymer, and so on, sufficient strength of the layer as well as sufficient uniformity in dispersion of the conductive particles can be obtained.

The acrylic monomer curable with light serving as the binder in the present embodiment is selected, for example, from the ones shown bellow. However, any well known acrylic monomers curable with light can be used.

TABLE 1

<Examples of Acrylic Monomers Curable with Light>

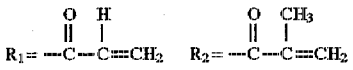

| structural formula | number of functional groups |
|---|---|
| (1) 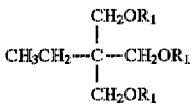 | 3 |
| (2) 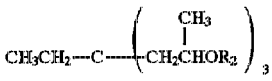 | 3 |
| (3) 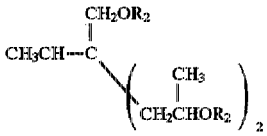 | 3 |
| (4) 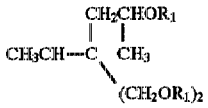 | 3 |
| (5) 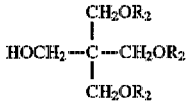 | 3 |
| (6) 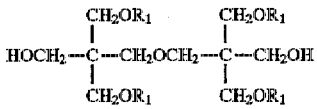 | 4 |

TABLE 2

| structural formula | number of functional groups |
|---|---|
| (7) 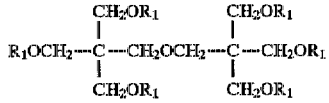 | 6 |

TABLE 2-continued

| structural formula | number of functional groups |
|---|---|
| (8) 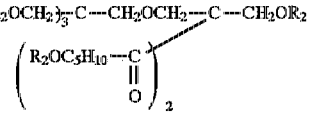 | 6 |
| (9) 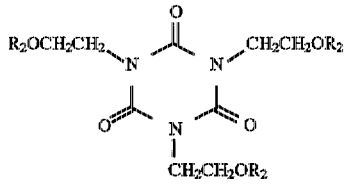 | 6 |
| (10) $CH_3CH_2C(CH_2OC_3H_6OR_1)_3$ | 3 |
| (11) 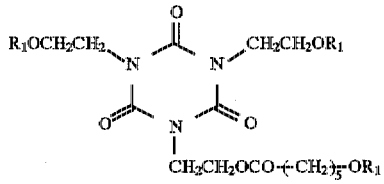 | 3 |
| (12) $(R_1OCH_2)_3C—O—C(CH_2OR_1)_3$ | 6 |

TABLE 3

| structural formula | number of functional groups |
|---|---|
| (13) $(R_1OCH_2)_3C—CH_2OCH_2—C(CH_2OR_1)_2$ (H) | 5 |
| (14) $(R_1OCH_2)_3C—CH_2OCH_2—C(CH_2OR_1)_2$ ($CH_3$) | 5 |
| (15) $(R_1OCH_2)_3C—CH_2OCH_2—C(CH_2OR_1)_2$ ($CH_2OH$) | 5 |
| (16) $(R_2OCH_2)_3C—CH_2OCH_2—C(CH_2OH)_2$ ($CH_2OR_2$) | 4 |
| (17) $(R_1OCH_2)_3C—O—C(CH_2OR_1)_2$ ($CH_2OH$) | 5 |
| (18) 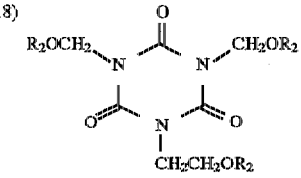 | 3 |
| (19) $CH_3CH_2—C(CH_2CH_2OR_1)_3$ | 3 |
| (20) $HOCH_2C(CH_2O—C(=O)CH_2CH_2CH_2CH_2CH_2OR_1)_3$ | 3 |

TABLE 3-continued

| structural formula | number of functional groups |
|---|---|
| (21) 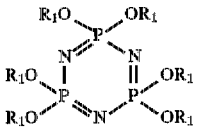 | 6 |

In this embodiment, since acrylic resin curable with light is used in the surface layer, photo-initiator is added to the prepared mixture used to form the surface layer. The amount of the photo-initiator to be added is 0.1 to 40 wt % of the weight of the acrylic monomer curable with light, preferably 0.5 to 20 wt %. Examples of typical photo-initiators includes those shown below.

TABLE 4

<Examples of photo-initiators>

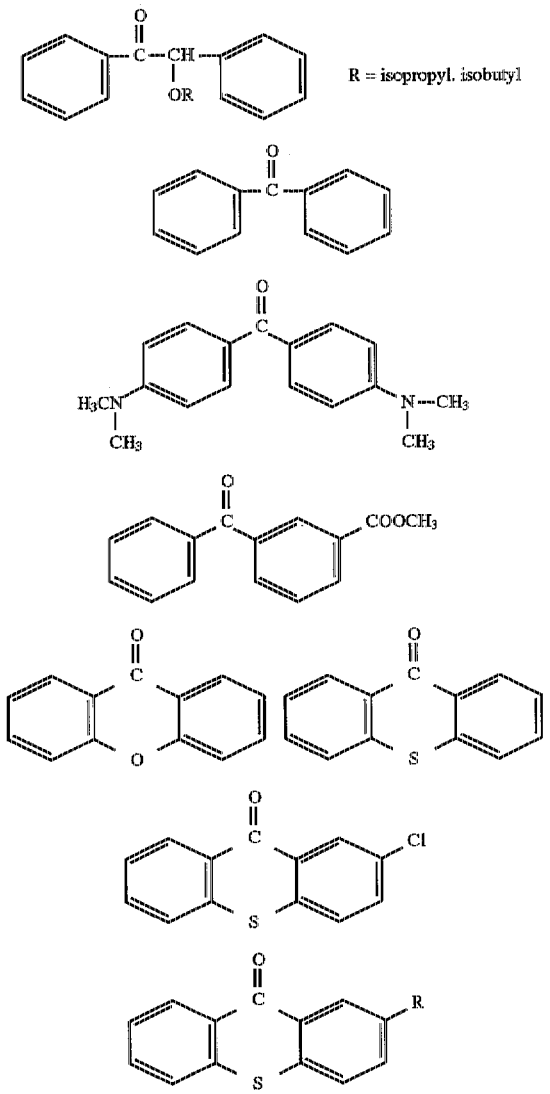

TABLE 4-continued

<Examples of photo-initiators>

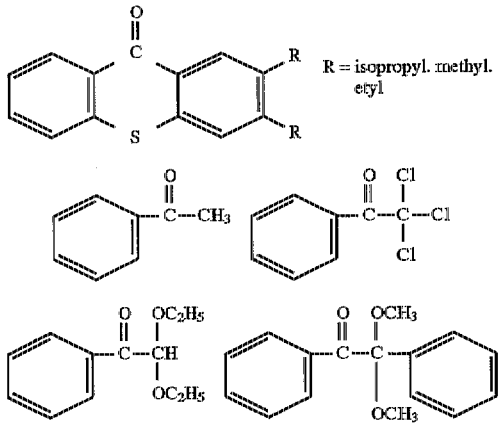

In this embodiment, the surface layer is formed on the photosensitive layers by the above-mentioned beam coating. Other coating technique such as the spray coating technique may be employed. Or, the dip coating can also be used with properly selected solvent. The thickness of the surface layer is determined in consideration of the electric resistance of the layer. Preferably, the thickness of the surface layer is from 0.1 to 10 μm, most preferably from 0.5 to 5 μm.

As the photosensitive layers, well known layers may be formed, including those containing inorganic photosemiconductors such as Se, $As_2Se_3$ a-Si, CdS, $ZnO_2$, and so on, and those containing organic layers such as PVK-TNF, phtalocyanine pigment, azo pigment, and so on.

Optionally, an intermediate layer may be provided between the photosensitive layers and the surface layers for protecting them. Such an intermediate layer is provided in order to further bind the surface layer and the photosensitive layers, or to serve as a barrier layer for blocking electric charge.

The material for the intermediate layer may be selected from the resin materials, for example, resin, polyester resin, polyamide resin, polystyrene resin, acrylic resin, silicone resin, all available on the market.

The conductive substrate drum of the photosensitive body may be made of metal such as aluminum, nickel, stainless steel, steel, and so on, and plastic or glass provided with a conductive layer, and paper treated to exhibit conductivity, and so on.

(3) Contact Charging Member 2

In the present embodiment, the charged brush is employed as the contact charging member 2. The charged brush 2 is a roller brush having an outer diameter of 14 mm, which comprises a metal core bar 2*a* having a diameter of 6 mm and tap 2*b* coiled spirally round the metal core bar 2*a*. The tape 2*b* is pile fabric of conductive rayon fibre REC-B manufactured by Unichika Ltd. (300 denier/50 filaments, density of 155 filament per square millimeter). The resistance of the brush is $1\times10^5$ Ω while being applied with voltage from 1 to 1000 V (Resistance was calculated from the current measured when the brush was kept in contact with a metal drum having a diameter of 30 mm, with a nip having a width of 3 mm and a longitudinal width of 230 mm, and was applied with voltage).

If the photosensitive body 1 has a defect such as a pin hole, excessive leak current flows through the hole and poor charge of the charging nip may happen, which causes a defective image. To prevent such a defective image, the resistance of the charged brush should be $1\times10^4$ Ω or more. Preferably, in order to give sufficient electric charge to the surface of the photosensitive body, the resistance is $1\times10^7$ Ω or less. The material for the charged brush 2 may be selected from REC-B (manufactured by Unichika Ltd.), SA-7 (TORAY), Thunderon (NIHON SANMO CO., LTD.), Belltron (Kanebo Co., Ltd.), CLACARBO (Kuraray Co., Ltd.), rayon in which carbon is dispersed, ROVAL (MITSUBISHI RAYON CO., LTD.), and so on. In consideration of stability against charges in environment, preferable examples of the material for the charged brush 2 include REC-B, REC-C, REC-M1 and REC-M10, all manufactured by Unichika Ltd.

In the present embodiment, the charged brush 2 is rotated so as to move in the direction opposite to the direction in which the surface of the photosensitive body 1 moves at the contact area. And the charged brush 2 is rotated at a rotating speed of 500 rpm (ratio of the circumferential speed is −414 %, which is calculated as described later). The charged brush 2, however, may be rotated at different rotating speed. Most preferable rotating speed varies according to the width of the charging nip formed between the charged brush 2 and the photosensitive body 1, the density of the bristles of the brush, the resistance of the layer to be filled with electric charge of the photosensitive body 1, the process speed (circumferential speed of the photosensitive drum), and other conditions. The charged brush 2 may also be rotated so as to move in the same direction in which the surface of the photosensitive body 1 moves at the contact area. In this case, however, since the amount of electric charge given to the photosensitive body 1 increases as the absolute value of the ratio of the circumferential speed of the charged brush 2 to that of the photosensitive body 1 increase, the charged brush 2 has to be rotated at a higher rotating speed to obtain the same absolute value of the ratio of circumferential speeds. Thus, it is preferable to rotate the charged brush 2 and the photosensitive body 1 in the opposite directions at the contact area because the charged brush 2 can be rotated at a low rotating speed.

When the charged brush 2 and the photosensitive body 1 are moved in the opposite direction at the contact area, the part of the charged brush 2 which comes out from the charging nip does not come into contact again with the photosensitive body 1 until the charged brush 2 makes a turn, when the part of the charged brush is no longer charged up. But, when the charged brush 2 and the photosensitive body 1 are moved in the same direction at the contact area, the part of the charged brush 2 which comes into contact with the photosensitive body 1 further comes into contact with other part of the surface of the photosensitive body 1 downstream in the charging nip because the charged brush 2 moves faster than the surface of the photosensitive body 1. As a result, part of the brush which comes near the downstream end of the charging nip has been already charged up with positive electric charge, and cannot fill the photosensitive body 1 with electric charge even if they come into contact with each other. In short, when the charged brush 2 and the photosensitive body 1 are moved in the same direction at the contact area, electrification performance is reduced. The "charged up" state is defined as a state in which the brush which has already given negative electric charge to the photosensitive body is further charged with positive electric charge accumulated at the tips of the bristles to have a different potential from that of the core bar of the charging brush.

The above-mentioned ratio of the circumferential speeds is calculated as follows;

$$\text{Ratio}(\%) = \frac{(\text{Speed of Brush}) - (\text{Speed of Drum})}{\text{Speed of Drum}} \times 100$$

wherein the circumferential speed of the charged brush has a positive value when the brush is moved in the same direction of the surface of the photosensitive body at the contact area, and a negative value when moved in the opposite direction.

(4) Principles of Electrification

Principles of electrification using the photosensitive body 1 and the contact charging member 2 described above will be described.

In the present embodiment, the contact charging member 2 having a medium resistance gives electric charge directly to the surface of the photosensitive body 1 having a medium resistance without electrical discharge. More specifically, in the present embodiment, electrification is performed by filling a trap potential of the material used for the surface of the photosensitive body with electric charge, or filling the conductive particles a in the surface layer 16 with electric charge.

Figure 3:
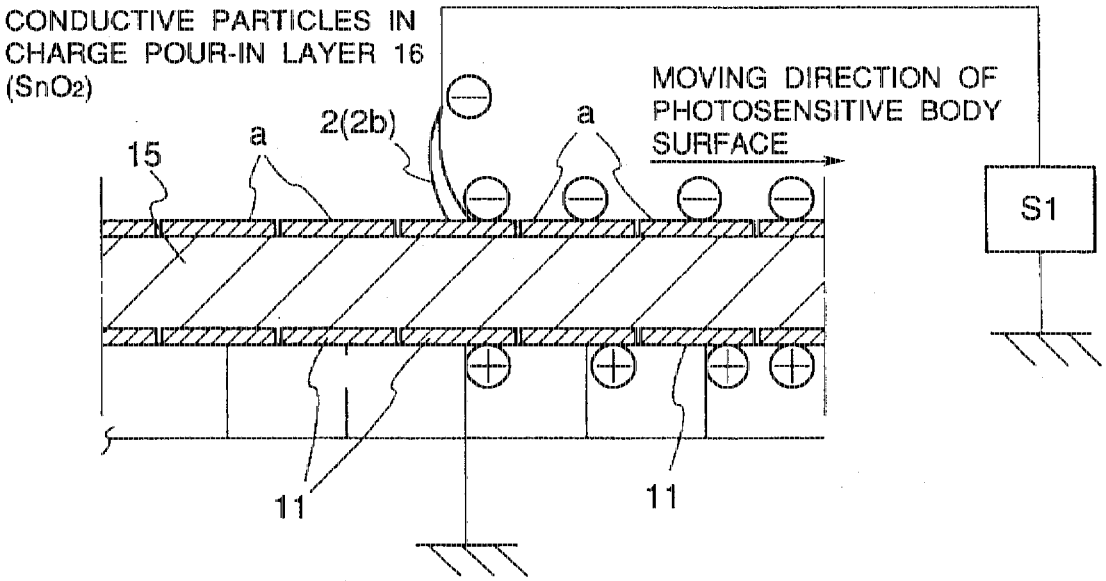
FIG. 3 is a view illustrating an equivalent circuit including a photosensitive body and a charged brush.
Figure 4A:
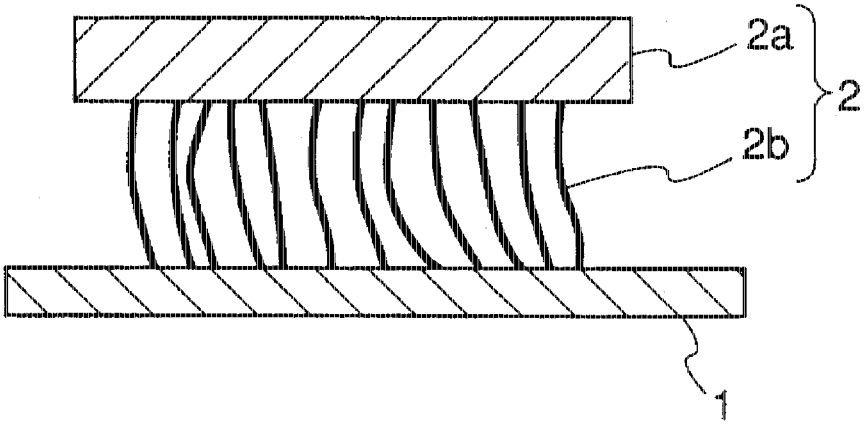
FIG. 4 is a view showing a state in which the bristles of a brush come into uniform contact with the surface of a body to be electrified.
FIG. 4B is a view showing a state in which the bristles of a brush do not come into uniform contact with the surface of a body to be electrified, with a space between bristles.
Figure 4B:
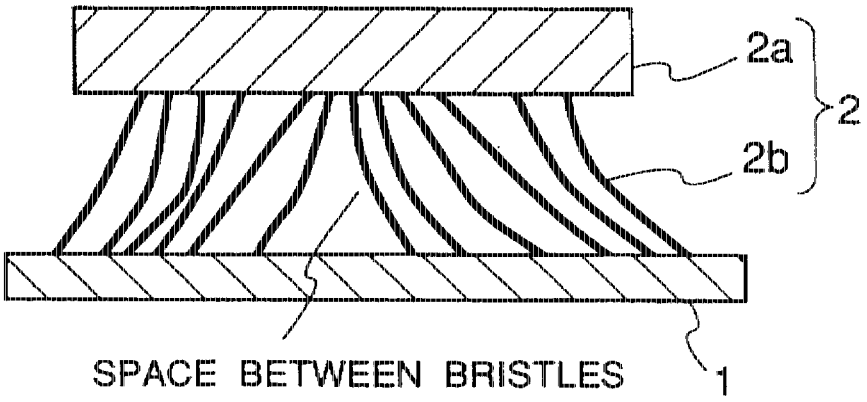

FIG. 3 shows an equivalent circuit, which illustrates the principles of electrification employed by the present embodiment. Here, a small condenser is formed, wherein the electric charge carrying layer 15 of the photosensitive body 1 serves as a dielectric substance, and the substrate drum 11 and the conductive particles ($SnO_2$) a in the surface layer 16 (charge pour-in layer) as electrodes. This condenser is charged by the contact charging member 2. In this condenser, each conductive particle a is electrically independent of the others, and performs as a kind of small float electrode. As a result, macroscopically, the surface of the photosensitive body is uniformity charged, but, in fact, the surface of the photosensitive body is covered with innumerable fine charged particles of $SnO_2$. Therefore, the electrostatic latent image can be supported by the electrically independent $SnO_2$ particles after the image exposure operation L with laser beams. Electrification can be executed when the resistance of the surface layer 16 is in a range from $1\times10^9$ to $1\times10^{14}$ Ωcm. In consideration of change in the resistance under the high temperature-high humidity and low temperature-low humidity conditions, the resistance of the surface layer 16 is preferably in a range from $1\times10^{12}$ to $1\times10^{13}$ Ωcm.

The volume resistance is calculated from the measured current obtained as follows. A prepared mixture to form the surface layer 16 is poured between two metal electrodes which are separated from each other at a distance of 200 μm. The mixture is formed into a layer. Then, a voltage of 100 V is applied between the electrodes.

Excellent characteristics of electrification can be obtained when the resistance of the surface of the body to be electrified is from $1\times10^9$ to $1\times10^{14}$ Ωcm and, at the same time, the contact angle of the surface of the body to be electrified is 90° or greater. As long as the above conditions are present, excellent characteristics of electrification. can also be obtained by employing any surface layer having other construction.

(5) Uniformity of Electrification and Other Characteristics

In this embodiment, as the material for the surface of the photosensitive body 1, which serves as the body to be electrified, the material having small surface energy is employed to reduce the coefficient of friction. As a result, the bristles of the charged brush 2 can come into uniform contact with the surface of the photosensitive body. At the same time, as the torque required to rotate the charged brush 2 is reduced, non-uniform rotation can be prevented.

More specifically, the present embodiment is characterized in that functional separation type OPC is used for the photosensitive body 1 serving as the body 1 to be electrified and that the photosensitive body 1 is coated with the surface layer 16 having small surface energy.

Hereinafter, as the index of the surface energy, the contact angle of the material to be used and water is shown. Images were formed by the printer (see FIG. 1) using the above-mentioned photosensitive body 1.

As a control, a photosensitive body coated with a surface layer 16 in which teflon particles b are not dispersed was used. In this case, the surface energy of the acrylic resin serving as the binder of the surface layer 16 was great, and the coefficient of friction between the surface of the photosensitive body and the developer was also great. As a result, there occurred a space between the bristles of the charged brush 2, as shown in the cross-sectional view FIG. 4B, which causes non-uniformity in the charged surface of the photosensitive body 1.

According to the contact charging technique which does not utilize electrical discharge, non-uniformity of electrification occurs because the part of the surface of the photosensitive body 1 to be electrified which does not come into direct contact with the charged brush 2 serving as the contact charging member is not sufficiently charged while the other part sufficiently charged. At the same time, in this example, large torque to rotate the charged brush 2 causes non-uniform rotation, which causes non-uniformity in the charged surface of the photosensitive body 1 in the sub-scan direction in which the surface is moved. This non-formity in the charged surface has a bad influence on the image to be formed. In addition, after long-term use, abrasion of the tips of the bristles 2*b* of the charged brush 2 hinders uniform electrification of the photosensitive body 1.

On the other hand, in the present embodiment whose photosensitive body 1 has the surface layer 16 in which the teflon particles b are dispersed, the surface energy of the surface of the photosensitive body 1 and the coefficient of friction could be reduced. As a result, the tips of the bristles of the charged brush 2 could come into uniform contact with the surface of the photosensitive body 1, which realized uniform electrification of the photosensitive body 1. At the same time, since the torque required to rotate the charged brush 2 was reduced, non-uniform rotation could be prevented to realize uniform electrification. In addition, even after long-term use, the tips of the bristles 2*b* of the charged brush 2 were free from abrasion and still could uniformly charge the surface of the photosensitive body 1. Thus, the present invention could form an excellent image.

Table 5 shows the results of the experiments on relations between the amount of the teflon particles b dispersed in the surface layer 16 and the electrification characteristics: the contact angles of the surface of the photosensitive body 1 for water; uniformity of electrification; uniformity of electrification in the longitudinal direction; and abrasion of the charged brush 2.

TABLE 5

| Amount of Dispersed Teflon (wt %)* | Contact Angle for Water | Uniformity of Electrification | Uniformity of Electrification in Longitudinal Direction | Abrasion of Brush |
|---|---|---|---|---|
| 0 | 85° | x | x | x |
| 17.6 | 88° | x | Δ | x |
| 26.3 | 90° | o | o | Δ |
| 30 | 92° | o | o | o |
| 39 | 95° | o | o | o |
| 46 | 100° | o | o | o |

*wt % in total weight of solid matter

Table 5 shows that if the contact angle for water is 90° or more excellent uniformity of electrification can be obtained even in the sub-scan direction, and that if 95° or more abrasion of the brush can be sufficiently reduced to obtain an excellent image as well as to prevent the charged brush 2 from making a flaw on the surface of the photosensitive body 1.

As described above, if a material which exhibits a contact angle for water of 90° or more, preferably 95° or more, is used for the surface of the photosensitive body 1, an excellent image can be obtained.

Figure 5:
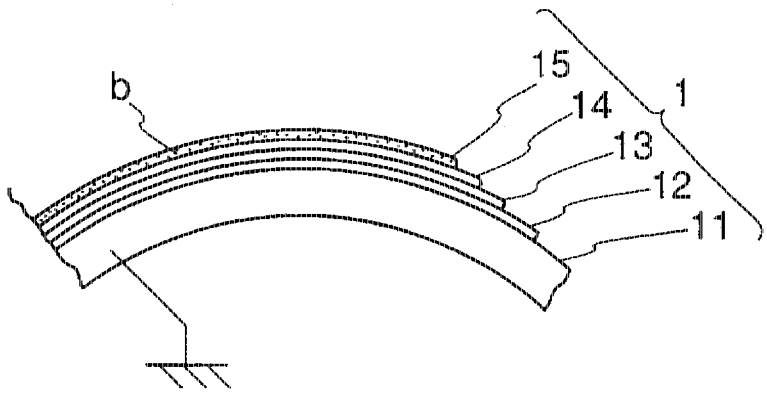
FIG. 5 is a cross-sectional view showing a model of the layer structure of a photosensitive body in an apparatus of the second embodiment according to the present invention.

<Second Embodiment> (FIG. 5)

While, in the first embodiment, the above-mentioned desirable effect is obtained by dispersing the teflon particles b in the surface layer 16 of the photosensitive body 1, the present embodiment is not provided with the surface layer 16 to which electric charge is given. Instead, as shown in FIG. 5, the electric charge carrying layer 15 of the photosensitive body 1 serves as a surface layer, to which the teflon particles b or the like are dispersed to reduce surface energy.

More specifically, hydrazone and the teflon particles b were dispersed in polycarbonate resin, which serves as the binder of the electric charge carrying layer 15, as described with respect to the first embodiment. The amount of the dispersed teflon particles b was 10 wt % in the total weight of solid matter. The contact angle for water of thus prepared photosensitive body 1 was 92.7°.

As the photosensitive body 1 of the present embodiment is not coated with the surface layer to which electric charge is given, it is preferable to reduce the resistance of the charged brush 2 in order to give electric charge to the trap level of the electric charge carrying layer 15. Therefore, REC-C manufactured by Unichika ltd. was used for the charged brush 2. The resistance of the charged brush 2, which was measured in the same way as the first embodiment, was $2\times10^4$ Ω when voltage from 1 to 1000 V was applied.

Images were formed with the same printer as the first embodiment (see FIG. 1) except that the surface of the photosensitive body 1 and the charged brush 2 of this embodiment were different from those of the first embodiment. Sufficient uniformity of electrification could be realized. Non-uniformity of electrification in the sub-scan direction caused by non-uniform rotation of the charged brush could be prevented. Abrasion of the brush was sufficiently reduced even after long-term use, which further ensured good images. In addition, the charged brush could be prevented from making a flaw on the surface of the photosensitive body.

Since the photosensitive body of the second embodiment is not provided with the surface layer 16, one of the processes to manufacture the photosensitive body can be omitted. As a result, the cost can be reduced.

<Third Embodiment>

In this embodiment, the material to form the surface layer of the photosensitive body has small surface energy. More specifically the outermost layer, the electric charge carrying layer 15 or the surface layer 16 described before, of the photosensitive body 1 is made of, as the binder, fluororesin having small surface energy.

In this embodiment, the outermost layer of the photosensitive body was actually the electric charge carrying layer 15. As the binder of this layer 15, amorphous fluororesin SYTOP (trade mark of ASAHI GLASS CO., LTD.) which is transparent and can be coated was used. In this binder, hydrazone was dispersed. Thus prepared photosensitive body exhibited a contact angle of 120.5° for water.

The same printer (FIG. 1) as the first and second embodiment and the same charged brush as the second embodiment were used with the above-mentioned photosensitive body to form images. Excellent uniformity of electrification could be realized, and non-uniformity of electrification in the sub-scan direction caused by non-uniform rotation of the charged brush could be prevented. Abrasion of the brush after long-term use could be sufficiently reduced, which further ensured excellent image formation. In addition, the charged brush could be prevented from making a flaw on the surface of the photosensitive body.

Since teflon particles are not dispersed in the binder of the electric charge carrying layer 15 serving as the outermost layer of the photosensitive body, laser beams are not scattered by the teflon particles at the time of the image exposure process. As a result, a clear latent image can be formed. Similar desirable effects can also be obtained when the photosensitive body is provided with the surface layer 16 (as the outermost layer), wherein fluororesin having small surface energy is used as the binder of this surface layer 16.

Figure 6:
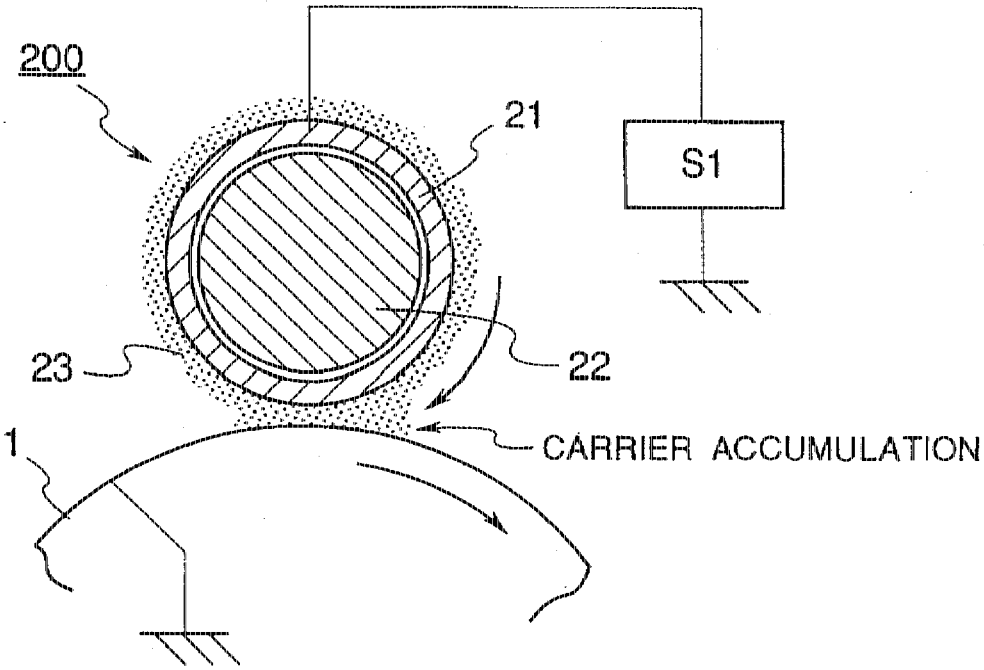
FIG. 6 is a schematic view showing the main constituents of an apparatus of the fourth embodiment according to the present invention.

<Fourth Embodiment> (FIG. 6)

In this embodiment, a magnetic brush is used as the contact charging member.

The object of this embodiment is to reduce the surface energy of the surface of the photosensitive body as well as the coefficient of friction between the surface of the photosensitive body and the magnetic brush, and realize smooth movement of magnetic particles on the surface of the photosensitive body in the charging nip between the magnetic brush and the photosensitive body. Thus, the magnetic particles can more often come into contact with the surface of the photosensitive body and charging performance is improved.

In FIG. 6, a conductive magnetic brush 200 serving as the contact charging member is positioned in contact with the photosensitive body 1. The magnetic brush 200 comprises a non-magnetic rotary electrode sleeve 21 having a diameter of 16 mm, a fixed magnet roller 22 having a longitudinal dimension of 230 mm, and magnetic particles 23 attracted by the magnetic roller 22. In order to improve performance to charge the photosensitive body 1, the electrode sleeve 21 is rotated as indicated by an arrow in FIG. 6 so that the electrode sleeve 21 and the surface of the photosensitive body 1 are moved in the opposite directions at the contact area, that is, in the nip. The circumferential speed of the magnetic brush is 100 mm/sec.

The magnetic particles 23 are ferrite carrier (mean diameter 30 μm, maximum magnetization 60 $Am^2/kg$, density 2.2 $g/cm^3$, resistance $5\times10^6$ Ωcm). The resistance is calculated from the measured current obtained when 2 g of the carrier particles which are put in a metal cell having a base area of 228 $mm^2$ and which are subjected to a load of 6.6 $kg/cm^2$ is applied with a voltage of 100 V.

The electrode sleeve 21 and the photosensitive body 1 are positioned with a distance of 500 μm in between. 10 g of carrier particles 23 are applied on the electrode sleeve 21. In this case, the carrier particles 23 form a nip having a width of ca. 2 mm between the electrode sleeve 21 and the photosensitive body 1. Since there is a difference between the circumferential speed of the magnetic brush 200 and that of the photosensitive body 1, carrier particles 23 accumulate with a width of ca. 3 mm on the upstream side, with respect to the direction of rotation of the sleeve 21, of the nip. That is, the entire charging nip has a width of ca. 5 mm. An electric power source S1 for applying charging bias applies a DC charging bias voltage of −700 V to the magnetic brush 200. And the outer peripheral surface of the rotating photosensitive body 1 is uniformly charged with about −700 V.

Image were formed with the same printer (FIG. 1) as the above-mentioned embodiments, and the magnetic brush 200. The obtained images were compared with those obtained with a conventional apparatus. Note that except the contact charging member this embodiment is the same as the first embodiment.

For comparison, images were formed with the photosensitive body 1 coated with the surface layer 16 in which the teflon particles were not dispersed. In this example, since the surface energy of the acrylic resin itself, which serves as the binder of the surface layer 16 was great, the coefficient of friction between the surface of the photosensitive body 1 and the magnetic particles was also great. Accordingly, the magnetic particles could not easily move over the surface of the photosensitive body 1, but were packed in the charging nip. Thus the magnetic particles near the surface of the photosensitive body stagnated in the nip. Stapnation of the magnetic particle caused non-uniformity in the nip, wherein chances for the magnetic particles to come into contact with the surface of the photosensitive body 1 was reduced in part of the nip. As a result, non-uniformity of electrification and poor charging performance which caused poor charge occurred. In addition, since stagnated magnetic particles were easily charged up, those particles could not charge the photosensitive body and caused poor charge.

On the other hand, the photosensitive body 1 of this embodiment is coated with the surface layer 16 in which the teflon particles b were dispersed could reduce its surface energy and the coefficient of friction of its surface. Accordingly, the magnetic particles 23 could smoothly roll and move over the surface of the photosensitive body. Thus chances for the magnetic particles 23 which were not yet charged up to come into contact with the photosensitive body 1 increased. Accordingly, poor charge could be prevented, and excellent images could be obtained. Since the magnetic particles 23 could move smoothly in the charging nip, uniformity in the nip as well as uniformity of electrification in the longitudinal direction of the sleeve could be improved. In addition, torque to rotate the magnetic brush was reduced, and the magnetic brush rotated uniformly. As a result, non-uniformity of electrification caused by non-uniform rotation could be prevented. As the photosensitive body 1 was uniformly charged, the potential difference between carrier particles and the surface of the photosensitive body 1 caused by poor charge could be prevented, and also adhesion of the carrier particles to the photosensitive body 1 caused by said potential difference could be prevented. The adhesion of the carrier particles was further prevented because the contact angle of the surface of the photosensitive body 1 was 90° or more to improve mould release of the carrier particles.

Experiments on the relation between poor charge and the contact angle of the surface of the photosensitive body for water were carried out, wherein the amount of teflon particles b dispersed in the surface layer 16 was varied. Table 6 shows the results of the experiments.

TABLE 6

| Amount of Dispersed Teflon (wt %)* | Contact Angle for Water | Prevention of Poor Charge |
|---|---|---|
| 0 | 85° | x |
| 17.6 | 88° | x |
| 26.3 | 90° | o |
| 39 | 95° | o |
| 46 | 100° | o |

*wt % in the total weight of solid matter

As shown in Table 6, when the contact angle for water was 90° or more, poor charge could be prevented and excellent images were formed.

Though, in the present embodiment, laser scan exposure is executed to write image data on the photosensitive body 1, other technique can be used. For example, an LED head having LED element arrayed in the longitudinal direction of the image supporter may be positioned in front of the photosensitive body 1. Or line recording may be executed, for example, with an optical system consisting of a liquid crystal shorter and a light source, wherein the light source is turned on/off corresponding to signals from a controller. Instead of the photosensitive body, an insularlye (or dielectric) body having a surface layer to which electric charge is given may be used as the image supporter. In this case, for example, a multi Stylus recording head is used to form the latent image on the charged image supporter. The multi Stylus recording head has pin electrodes facing to the image supporter on the downstream side, with respect to the contact charging member, in the direction to which the image supporter is moved. The pin electrodes are arrayed in the longitudinal direction of the image supporter. Instead of reverse development, normal development may be carried out.

As the contact charging member, a conductive charging roller made of conductive, solid or porous material having low hardness may be used. For example, a conductive charging roller consisting of a core bar and an EPDM sponge layer having a specific volume resistance of $1\times10^5$ Ωcm is used (ASKER C hardness 45°). This conductive charging roller is positioned in contact with the body. to be electrified so as to form a nip having a width of 6 mm, applied with voltage, and rotated.

<Fifth Embodiment>

The image forming apparatus of this embodiment uses a photosensitive body for back surface exposure process which exhibits a contact angle of 90° or more for water. In this embodiment, a two-component developer is used, containing magnetic conductive carrier particles and magnetic insularlye toner. The magnetic conductive carrier particles contribute to cleaning of residual toner remaining after the transfer process, electrification of the surface of the photosensitive body, and conveyance of the toner.

Carrier particles brush the surface of the photosensitive body and scrape the toner which was not transferred onto the transfer medium at the time of the previous image forming process but remains on the surface of the photosensitive body (hereinafter such toner is referred as 'residual toner'). Simultaneously with this cleaning operation, the carrier particles give electric charge to the surface of the photosensitive body. But, if the developer does not smoothly move, it is packed, and stagnates in the nip between the developer sleeve and the photosensitive body. In this case, even if the developer sleeve is rotated faster, chances for the developer to come direct contact with the surface of the photosensitive body are not increased. As a result, poor cleaning performance and poor charge occur.

In order to solve these problems, as the material used for the surface of the photosensitive body for the back surface exposure process, the present embodiment employs a material having small surface energy. Thus, the object of the present embodiment, that is, realize smooth movement of the developer over the surface of the photosensitive body and to facilitate cleaning of the residual toner left at the time of the previous image forming process, can be achieved. More specifically, resin having small surface energy such as polypropylene is used for the surface of the photosensitive body and/or particles such as PTFE are dispersed in the surface of the photosensitive body, and so on.

In the present embodiment, a photosensitive body of functional separation type OPC coated with a surface layer having small surface energy is used. However, the materials and construction used in this embodiment do not set any limit the ideas of the present invention. Similar effects of the present embodiment can be obtained as long as material having small surface energy is used for the surface of the photosensitive body for the back surface exposure process.

As described, the contact angle of the material for water is used as the index of the surface energy of the material.

In this embodiment, the surface layer is made of insulative resin in which conductive particles are dispersed. In this photosensitive body, the photosensitive layers serve as a dielectric body, while the conductive particles serve as fine float electrode, which forms a condenser. With conductive developer, this condenser is charged.

According to the conventional simple processes, materials which do not have a level to trap electric charge can not used for the photosensitive body, which makes selection of materials difficult. But, with the photosensitive body having the above-mentioned surface layer, electric charge can be given to the conductive fine particles. As a result, excellent electrification can be realized with various materials for the photosensitive body.

Now, the electrophotography apparatus of back surface exposure type used in the present embodiment will be described.

Figure 7:
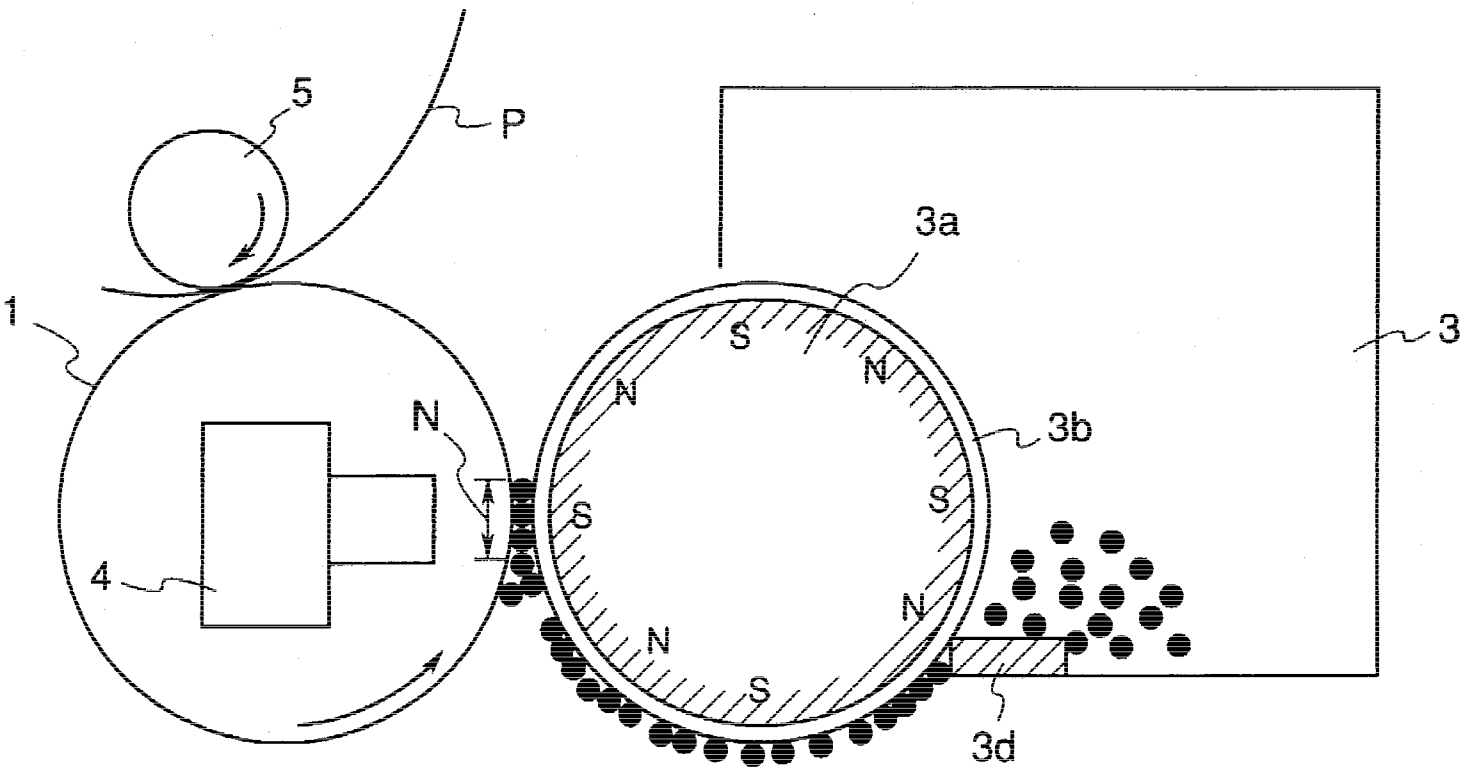
FIG. 7 is a schematic view showing an apparatus of the fifth embodiment according to the present invention.
Figure 8:
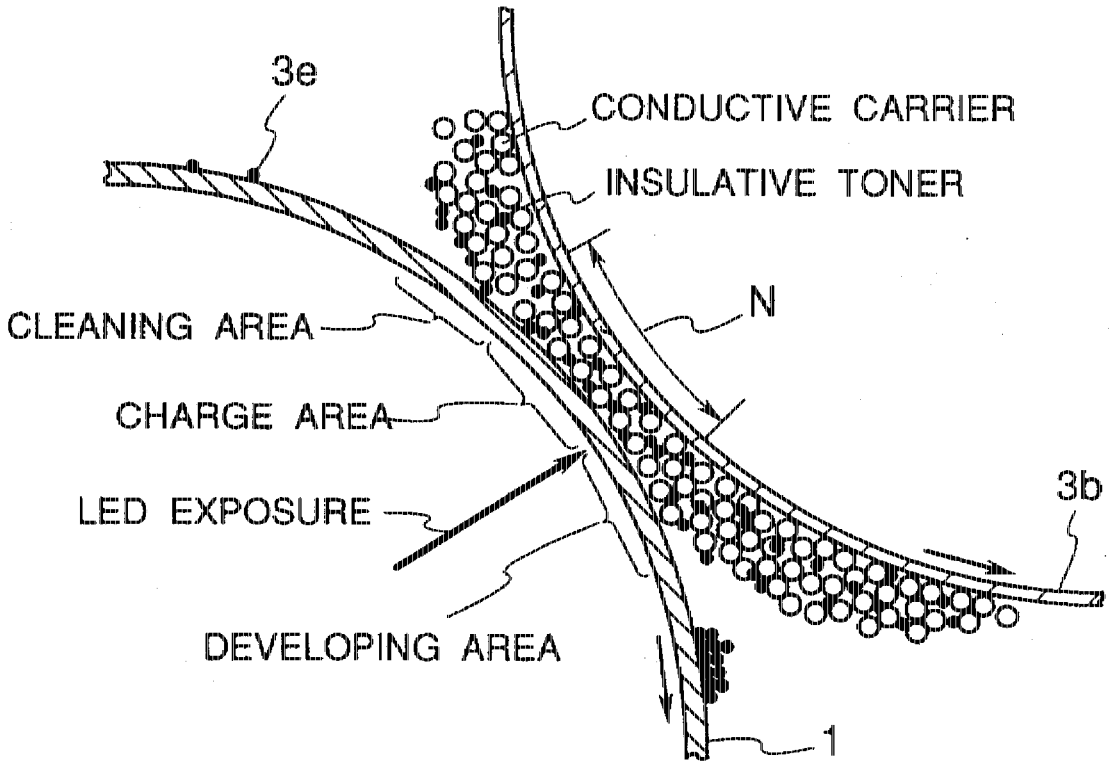
FIG. 8 is a schematic view showing the main constituents of a back surface exposure apparatus.
Figure 9:
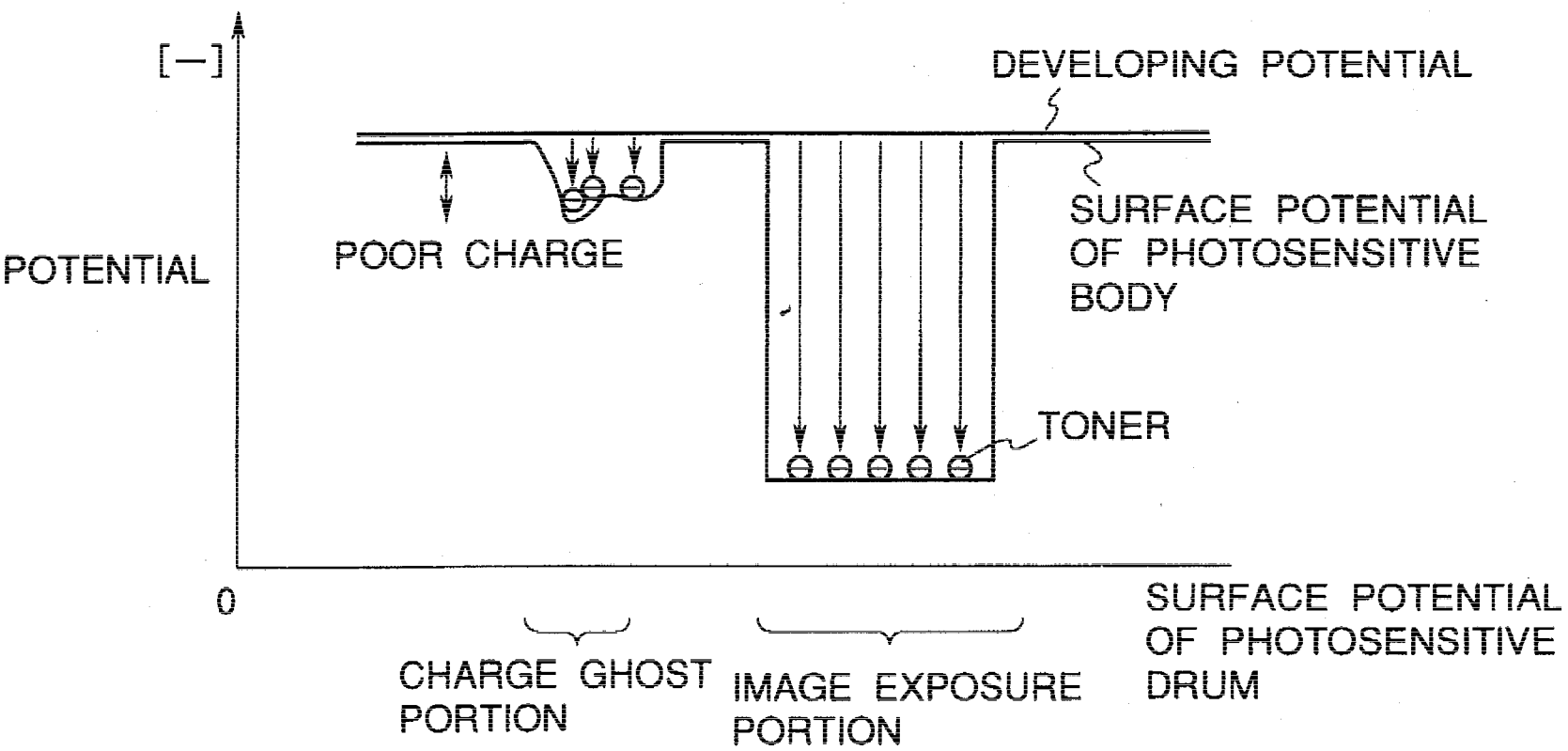
FIG. 9 is a diagram showing the relation among potentials used for the back surface exposure technique.

FIG. 7 schematically shows the elecrophotography apparatus, which comprises a photosensitive drum 1, an exposure device 4, a developer device 3, a transfer device 5, a fixing device (not shown), and so on.

The photosensitive body 1 is a transparent glass cylinder having a diameter of 30 mm, on which photosensitive layers are to be laminated. Instead of the glass cylinder, a cylinder made of transparent resin having dimensional stability can be used. Also a cylinder made of polycarbonate resin, PMMA resin, and the like, may be used.

First, an ITO layer of ca. 1 μm serving as a transparent conductive layer is formed by coating. Thereon an electric charge inhibiting layer for blocking electric charge from the surface of the cylinder (UCL, film thickness ca. 20 μm, medium resistance), an electric charge generating layer (CGL, film thickness ca. 1 μm, polyvinylbutyral resin binder +disazo pigment), a p-type electric charge carrying layer (CTL, film thickness ca. 20 μm, acrylic resin binder+hydrazone), and further the surface layer characteristic of the present embodiment are laminated in the named order. Thus, the OPC photosensitive body of functional separation type is prepared. The exposure device 4 comprising an LED head and a Selfox lens array is positioned inside the photosensitive body to radiate light to a predetermined position in the charging nip from the back surface of the photosensitive body. The developer unit (developer device) 3 comprises a rotating sleeve 3*b* having a diameter of 30 mm which is made of aluminum, stainless steel, and so on, and a fixed magnet 3*a* fixed in the sleeve 3*b*. The sleeve 3*b* is rotated at a circumferential speed six times as high as that of the photosensitive body, wherein the sleeve 3*b* is moved in the same direction as the photosensitive body at this contact area.

In the present embodiment, the process speed (circumferential speed of the photosensitive drum) is 50 mm/sec. Therefore, the circumferential speed of the sleeve 3*b* is 300 mm/sec. Eight magnetic poles are symmetrically arranged in the magnet roll 3*a*. Each magnetic pole has its peak position on the straight line between the center of the photosensitive drum and the center of the developer sleeve. When each peak position on the surface of the sleeve 3*b* has a magnetic flux density of 800 gauss.

The magnetic insulative toner employed is negative toner, with a particle diameter of 7 μm and an electric resistance of $1\times10^{14}$ Ωcm. The carrier particles have a diameter of 25 μm and a resistance of $1\times10^{2}$ Ωcm.

The toner and the carrier particles are mixed at a T/D rate of 8 wt % (T; toner, D; total developer). This mixture is put in the developer device 3, in which a metal blade 3*b* for regulating the thickness of the toner coat on the developer device is arranged to face to the developer sleeve 3*b* to make the thickness of the toner coat from the sleeve surface about 1 mm. The developer sleeve 3*b* and the photosensitive drum 1 are supported by contact rollers (not shown) at their end portion, with a distance of 0.5 mm in between. With this construction, when the photosensitive drum and the developer sleeve are rotated at their predetermined speeds, the contact nip N between them has a width of 7 mm. The photosensitive drum 1 is earthed, while the developer sleeve 3*b* is charged with a DC voltage of −100 V. Thus, reverse development is carried out with the negative toner.

With the above-mentioned apparatus, images were formed.

On the upstream side in the nip formed by the developer between the photosensitive body and the developer sleeve, the swiftly rotating magnetic brush scrapes the residual toner remaining after the transfer process. At the same time, the conductive carrier particles come into contact with the surface of the photosensitive body to charge the photosensitive body.

Thus charged photosensitive body is subjected to the back surface exposure process, wherein the lighted portion is discharged to form lighted portion potential.

After exposure, in the nip formed by the developer, the insularire toner forms a toner image on the photosensitive body according to the given electric field. Since the conductive carrier particles serve as closely arranged electrodes in this embodiment, a sufficient image density can be obtained even with a small voltage having an absolute value of about 100 V.

Next, the toner image is transferred onto a transfer medium P by the rotating transfer roller 5. The transfer roller 5 used is the present embodiment has a volume resistance of $5\times10^{8}$ Ωcm, and is applied with a bias voltage of +2 KV. The toner which is not transferred by the transfer device is sufficiently scraped off on the upstream side in the charging nip at the time of next image forming operation. Accordingly, the residual toner does not hinder the next image forming operation.

The transferred toner image is fixed by the thermal fixing roller, and the transfer medium having the printed image is discharged out of the apparatus. Now, the surface layer of the photosensitive body characterizing the present embodiment will be described. The surface layer is formed as follows. 60 volumes of acrylic resin curable with light, 60 volumes of stannic oxide in which antimony is doped to obtain conductivity, 50 volumes of PTFE particles having the mean diameter of 0.18 μm, 2-methyl thioxanthone serving as a photo-initiator, and 400 volumes of methanol are used to prepare a dispersion mixture. The photosensitive drum is coated with the prepared mixture by dip coating technique. And the mixture is cured to form the surface layer having a thickness of ca. 3 mm and a volume resistivity in the order of $10^{13}$ Ωm. The electric charge of the latent image can not drift in the periferal directions, thus, a blurred image can be prevented. On the other hand, electric charge can move little in the direction of the thickness of the layer, which minimizes the potential remaining after the image exposure process.

In order to reduce the surface energy of the photosensitive body and realize smooth movement of the developer over the surface of the photosensitive body, teflon particles are dispersed in the binder, in this embodiment, since the surface energy of the teflon itself is very small, that is, about 20 dyne/cm, surface energy of the photosensitive body can be remarkably reduced by dispersing teflon. While the surface of acrylic resin/stannic oxide in which teflon is not dispersed exhibits a contact angle of 85° for water, the contact angle of the surface in which teflon is dispersed can be improved to be 90°.

Images were formed by using the above-mentioned photosensitive drum. First, as a control, a photosensitive body in which teflon particles were not dispersed was used. In this case, since the surface energy of the acrylic resin itself was great and the coefficient of friction between the surface of the photosensitive body and the developer was also great, the developer could not easily move over the surface of the photosensitive body, but was packed in the charging nip, and stagnated in it. In addition, since the surface energy of the photosensitive body was great, the residual toner after the transfer process strongly adhered to the photosensitive body, which reduced the cleaning performance in the charging nip and caused a ghost image.

On the other hand, in the present embodiment in which teflon particles were dispersed, the surface energy of the photosensitive body as well as the coefficient of friction could be reduced. As a result, cleaning of the residual toner after the transfer process became easier and no ghost image occurred. Since the developer could smoothly move over the surface of the photosensitive body, chances for the photosensitive body to come into contact with the carrier particles which had not been charged up were increased. Accordingly, poor charge could be prevented and excellent images could be obtained.

Experiments on the relation between the contact angle of the surface of the photosensitive body for water and the defect, that is, poor charge and the ghost image, were carried out, wherein the amount of teflon particles dispersed in the surface layer was varied. Table 7 shows the results of the experiments.

TABLE 7

| Amount of Dispersed Teflon (wt %)* | Contact Angle for Water | Prevention of Poor Charge | Prevention of Ghost Image |
|---|---|---|---|
| 0 | 85° | x | x |
| 17.6 | 88° | x | x |
| 26.3 | 90° | ○ | Δ |
| 39 | 95° | ○ | ○ |
| 46 | 100° | ○ | ○ |

*wt % in the total weight of solid matter

As shown in Table 7, if the contact angle for water was 90° or more, poor charge could be prevented. And if the contact angle for water was 95° or more, both poor charge and the ghost image could be prevented to obtain excellent images. These values of the contact angles were measured as follows. A drop of water was put on the surface of the photosensitive body, wherein the free surface of the water was in contact with the surface. And the angle, formed between the surface of the water rising from the surface of the photosensitive body and the bottom surface of the water being in contact with the surface of the photosensitive body, was measured.

Though, in the present invention, the desirable effects are obtained by dispersing the teflon particles in the surface layer, other techniques can be used. For example, teflon particles may be dispersed in the CT layer (electric charge carrying layer) of the photosensitive body. Or, the surface layer of the photosensitive body may be made of material having small surface energy.

More specifically, as the material used for the CT layer, amorphous transparent fluororesin CYTOP (ASAHI GLASS CO., LTD.) which can be formed by coating, and so on may be used.

By selecting the material having sufficiently small surface energy for the surface of the photosensitive body, poor charge which is especially troublesome for the back surface exposure technique and the ghost images which are caused because of low cleaning performance can be prevented.

More specifically, when the material used for the surface of the photosensitive body exhibits a contact angle of 90° or more for water, excellent images can be obtained.

<Sixth Embodiment>

In this embodiment, in order to improve smooth movement of the developer used in the back surface exposure technique, lubricating agent is added to conductive carrier contained in the developer. According to the back surface exposure technique, the carrier and the toner are mixed to perform electrification and development with one developer. When the carrier and the toner are mixed, fluidity of the developer is reduced and the carrier for electrification can not smoothly move on the surface of the photosensitive body. As a result, uniform electrification becomes difficult. This problem does not occur in electrification with carrier only. In the present embodiment, the developer employed is a two-component developer containing magnetic conductive carrier and magnetic insulative tonnet.

The magnetic conductive carrier contributes to cleaning of the residual toner after the transfer process, electrification of the surface of the photosensitive body, and conveyance of toner.

The carrier brushes the surface of the photosensitive body to scrape the toner (residual toner) which was not transferred onto the transfer medium at the time of the previous image forming operation but still remains on the surface of the photosensitive body. Simultaneously with this cleaning operation, the carrier gives electric charge to the surface of the photosensitive body. When the fluidity of the developer is not sufficient, however, the developer is packed, and stagnates in the nip between the developer sleeve and the photosensitive body. In this case, even if the developer sleeve is rotated faster, chances for the developer to come into direct contact with the surface of the photosensitive body can not be increased. As a result, cleaning performance is reduced and reliable electrification becomes difficult.

In order to prevent such defects, the developer has to move smoothly over the surface of the photosensitive body and sufficiently clean the surface as the developer sleeve is rotated. At the same time, the carrier having electric charge to give has to be continuously applied into the nip. In order to prevent the above-mentioned defects, in the present embodiment, the carrier particles are coated with silicone resin having an adjusted resistance to improve fluidity of the developer itself. More specifically, 40 weight volumes of conductive stannic oxide fine particles (diameter 0.04 μm) are dispersed in silicone resin to prepare coating material. The carrier particles are coated with thus prepared coating material to have desired resistance (described latter).

The core of the carrier particle used in the present embodiment was 25 μm, and its resistance was $1\times10^2$ Ωcm, and its fluidity was indicated by a value of 50 sec/50 g. The carrier particles were resin carrier particles made of phenol resin in which magnetite was dispersed and carbon black giving conductivity was also dispersed.

The fluidity is indicated by a value measured as follows. 50 g of the particles were put in a funnel, and the time required for all the particles to fall from the funnel was measured according to JIS-Z2502. Hereinafter, the fluidity is indicated by the value measured in this way.

The core of the carrier prepared as described above was coated with silicone resin. In the silicon resin, stannic oxide in which antimony was doped to obtain a desired resistance was dispersed. The present embodiment used acrylic silicone resin KR9706 (trade mark of Shinetsu Silicone), in which 10 wt % of stannic oxide was dispersed to obtain a volume resistance of $1\times10^4$ Ωcm. The surfaces of the carrier particles were coated with thus prepared coating resin by using SPIRA COTA (manufactured OKADA SEIKO CO., LTD.). The formed coat had a film thickness of 0.3 μm. After coating process, the carrier particles exhibited a volume resistance of $2\times10^2$ Ωcm, and fluidity was improved to 30 sec/50 g.

When the coat is thin, electric charge can move, as a tunnel current, from particle to particle. Therefore, the material of the coating layer itself does not have to be given conductivity.

Though, in this embodiment, silicone resin was used as the coating material, lubricant resin such as poly olefin resin, fluororesin, and so on, can be used. Similar desirable effect can be obtained without coating the carrier. For example, the core of the carrier particles may contain lubricant resin, or PTFE particles.

Images were formed, with the electrophotography apparatus of the back surface exposure type as in the fifth embodiment, by using the developer of this embodiment. The magnetic insulative toner contained in the developer was negative toner, with a particle diameter of 7 μm and an electric resistance of $1\times10^{14}$ Ωcm. The toner and the carrier was mixed at a T/D rate of 8% (weight ratio of the toner to the total developer).

In the present embodiment, the conductive carrier particles in the developer had sufficient lubricity. Accordingly, the developer was not packed nor stopped in the nip. And fluidity was not reduced. In this case, the developer sleeve rotated at a faster circumferential speed than the photosensitive drum could smoothly push the developer over the surface of the photosensitive body. As a result, the residual toner which had not been transferred onto the transfer medium at the previous image forming operation could be quickly cleaned from the photosensitive body and could not hinder the charging process.

In addition, since the carrier particles which had the same potential as the developer sleeve and had not yet been charged up could be continuously provided into the nip formed by the developer, chances to give electric charge to the photosensitive body were increased to execute excellent electrification.

As described above, according to the present embodiment, excellent images can be obtained with the apparatus of back surface exposure type, regardless of environmental disturbance.

As a control, images were formed with the same apparatus of back surface exposure type, by using developer containing carrier cores without coating.

As described before, the carrier core was a magnetic conductive core made of phenol resin serving as the binder in which magnetite and carbon black were dispersed. The fluidity was indicated by a value of 50 sec/50 g, which is not sufficient. With these carrier cores, images were formed. In a normal state, the obtained images were not defective. But, when the amount and/or the shape of the developer in the charging nip were not stably adjusted at the beginning of the image forming operation, and when the concentration of the toner (T/D ratio) in the developer became low and fluidity of the developer was reduced, the developer supplied into the nip was packed. In this case, the developer could not smoothly move over the surface of the photosensitive body.

In such a state, even if the developer sleeve is normally rotated, the developer only slip over the developer sleeve and can not be carried with the surface of the developer sleeve. And, in fact, the developer stagnates on the surface of the photosensitive body. Accordingly, the developer sleeve is idly rotated at a high circumferential speed, and the residual toner is not removed from the surface of the photosensitive body. In addition, lots of carrier particles which have already given electric charge to the photosensitive body and have been charge up, charged to their limit, stagnate over the photosensitive body, the photosensitive body can not sufficiently charged. As a result, poor charge and ghost images occur. The carrier particles are "charged up" when they have given electric charge to the photosensitive body and are charged to have a potential different to that of the developer sleeve.

Experiments on the threshold of occurrence of stagnation of the developer were carried out, wherein the fluidity of the carrier particles was varied. As shown in the Table 8 below, if the fluidity is not sufficient, more specifically, the time measured as described before is 45 sec/50 g or greater, considerable stagnation of the developer may occur.

TABLE 8

| Fluidity Indicated by Measured Time [sec/50 g] | Stagnation of Developer | Prevention of Poor Charge |
|---|---|---|
| 50 | + | x |
| 45 | + | Δ |
| 40 | + (negligible) | o |
| 35 | – | o |

In fact, the correlation between insufficient fluidity and stagnation of the developer partly depends on the type of the photosensitive body, the clearance between the developer sleeve and the photosensitive body, as well as the characteristics of the tonner employed. But, since the T/D ratio of the developer used for the back surface exposure technique is in the order of several percent, the main factor which influences the fluidity of the developer is the fluidity of the carrier particles.

As described above, in the conventional image forming apparatus of back surface exposure type, low fluidity of the developer may cause poor charge and ghost images. In the present embodiment, however, these problems characteristic of the back surface exposure can be prevented by reducing the fluidity of the carrier particles to a degree indicated by a value of 45 sec/50 g.

When a photosensitive body whose surface exhibits a contact angle of 90° or more for water is used in the present embodiment, the developer can move more smoothly over the surface of the photosensitive body, which further improves uniformity of electrification.

<Seventh Embodiment>

In this embodiment, the toner in the developer is given lubricity. Thus residual toner after the transfer process can be cleaned more easily, and the ghost images can be prevented. At the same time, as the fluidity of the developer increases, electrification characteristics can be improved as in the first embodiment.

Like the above-mentioned sixth embodiment, cleaning of the photosensitive body and electrification thereof are performed in the same charging nip according to the back surface exposure technique. Therefore, if the toner remaining after the transfer process of the previous image forming operation is not completely removed, this residual toner hinders electrification, which causes poor charge on part of the surface of the photosensitive body. Thus, ghost images occur.

In order to solve this problem, in the present embodiment, the toner in the developer is given lubricity to be easily cleared from the photosensitive body.

By giving lubricity to the toner, the fluidity of the developer can be improved. Generally, the fluidity of the developer mainly depends on the characteristics of the carrier. But, if toner having a smaller diameter than the carrier and excellent lubricity is added, the developer can move more smoothly in the charging nip, even when the amount of the added toner is small, that is, at T/D ratio in the order of several percent. More specifically, wax is contained in the toner particles to give lubricity. The toner of the present invention consists of styrene acrylic resin serving as the binder containing 50 volumes of magnetite as the magnetic material, anti-static agent and wax.

Images were formed with the apparatus of back surface exposure type used in the sixth embodiment. As a control, toner containing no wax was also used. As the carrier in the developer, the carrier cores without silicone coating, which were used in the sixth embodiment, were used.

First, images were formed with the control containing no wax. The residual toner used at the time of the previous image forming operation strongly adhered to the photosensitive body by mirroring force, van der Waals force, and so on. And the developer stagnated in the charging nip. As a result, at the beginning of the operation, and when the clearance between the phtosensitve drum and the developer sleeve was wider than a certain value and the charging nip became narrow, cleaning performance in the cleaning area in the nip was reduced. Thus, part of the photosensitive body on which the previous image had been formed was poorly charged, which sometimes caused ghost images.

On the other hand, when images were formed with the toner of the present invention which contained wax, the toner itself exhibited lubricity. Accordingly, when the magnetic brush brushed the surface of the photosensitive body in the charging nip, the toner covering the photosensitive body was easily stired and lifted off. Accordingly, sufficient cleaning performance could be easily obtained. Since the toner had lubricity, the fluidity of the developer was so good that the developer did not stagnate in the charging nip. As a result, ghost images could be prevented. Instead of adding wax, lubricating liquid or resin such as silicone oil, polypropylene, teflon particles, and so on may be added in the toner. Otherwise, in order to improve the fluidity of the toner, the toner may be mixed with silica, preferably silica treated with oil, titanium oxide particles and so on.

Also in the conventional electrophotography technique, wax is generally contained in the toner to improve fluidity of the toner, and lubricating fine particles are generally mixed with the toner to give lubricity to the toner. The object of adding these substances to the toner, however, is different from that of the present embodiment. That is, the object of adding these substances according to conventional art is mainly to improve conveyance of the toner at the time of the development process and development characteristics, and to prevent missing or void of the characters in a character image at the time of the transfer process.

The present embodiment is effective especially when applied to the apparatus of back surface exposure type which performs cleaning and electrification at the same time, wherein the lubricity and fluidity of the developer not only affect the cleaning performance but also electrification of the image supporter. In other words, improvement of fluidity of the developer which is now proposed according to the present embodiment has different object, different mechanism and further different effects from those of the conventional electrophotography technique.

As described above, according to the present invention, there is a difference between the circumferential speed of the contact charging member and the body to be electrified. Therefore, in a contact charging apparatus, or a process cartridge using the said charging device, uniform electrification of the body to be electrified can be realized.

As described above, according to the present invention, in the contact charging device in which there is a difference between the circumferential speed of the contact charging member and that of the body to be electrified, as well as in the image forming apparatus and the process cartridge which use such a contact charging device, desirable effects can be obtained. That is, the body to be electrified can be uniformly charged, the torque to rotate the contact charging member can be reduced, and abrasion and damage of the contact charging member and the body to be electrified can be prevented for long-term use. Further, in the image forming apparatus and the process cartridge using the contact charging device of the present invention, excellent images can be reliably obtained for a long time without disturbance in the obtained images caused by non-uniformity of electrification.

Especially in the image forming apparatus of back surface exposure type, stagnation of the developer near the surface of the photosensitive body, insufficient cleaning of the residual toner used for the previous image forming operation, and ghost images caused by such insufficient cleaning can be prevented. In addition, fogging is almost completely reduced to form excellent images.

What is claimed is:

1. An electrophotographic apparatus comprising:

a photosensitive body which includes a surface layer with a volume resistivity of $1\times10^{9}$ to $1\times10^{14}$ Ωcm, and a photosensitive layer disposed inside of the surface layer; and a charging member to which a voltage is applied to charge the photosensitive body, said charging member slidably contacting the surface layer of the photosensitive body, wherein the surface layer of the photosensitive body includes a lubricating material and conductive particles, and has a contacting angle of 90° or more relative to water.

2. An electrophotographic apparatus according to claim 1, wherein a moving direction of said charging member is opposite to a moving direction of the photosensitive body at a contact area between the photosensitive body and the charging member.

3. An electrophotographic apparatus according to claim 1, wherein said charging member comprises a fiber brush which comes into contact with said photosensitive body.

4. An electrophotographic apparatus according to claim 1, wherein said charging member is a magnetic brush having magnetic particles which come into contact with said photosensitive body.

5. An electrophotographic apparatus according to one of claims 1 to 4, wherein the surface layer of said photosensitive body further contains resin.

6. An electrophotographic apparatus according to claim 1, wherein said conductive particles are metal oxide.

7. An electrophotographic apparatus according to claim 1, wherein said lubricating material is selected from the group consisting of fluoro polymer, silicone polymer, fluoro oligomer and silicone oligomer.

8. An electrophotographic apparatus according to claim 1, wherein said lubricating material is a polymer or a copolymer of one or more materials selected from the group consisting of tetrafluoroethylene, hexafluoropropylene, trifluoroethylene, chlorotrifluoroethylene, vinylidene fluoride, vinyl fluoride, and perfluoro alkyl vinyl ether.

9. An electrophotographic apparatus according to claim 1, wherein said surface layer contains 5 to 60 wt % of lubricating material by weight.

10. An electrophotographic apparatus according to claim 1, wherein said lubricating material comprises particles having a mean diameter of 0.005 to 0.3 μm.

11. An electrophotography apparatus comprising:

a photosensitive body comprising of photosensitive layer and a substrate which supports the photosensitive layers and can transmit light; and a magnetic brush member positioned in contact with the photosensitive body which can be applied with voltage to charge the photosensitive body and perform development, wherein the magnetic brush member has magnetic conductive carrier and toner, and part of the back surface of the photosensitive body corresponding to the contact area with the magnetic brush member is exposed to light, and the fluidity of the carrier is reduced, at least, to a degree indicated by a value of 45 sec/50 g.

12. An electrophotography apparatus according to claim 11, wherein the surface of said photosensitive body exhibits a contact angle of 90° or more for water.

13. An electrophotography apparatus according to claim 11 or 12, wherein said oartier is particles consisting of magnetic cores and coating material covering the surfaces of the magnetic cores.

14. An electrophotography apparatus according to claim 11, or 12, wherein said toner is insulative toner containing wax.

15. An electrophotography apparatus according to claim 11 or 12, wherein said toner is insulative toner with which lubricating fine particles are mixed.

16. An electrophotography apparatus according to claim 12, wherein the surface of said photosensitive body contains lubricating material.

17. An electrophotography apparatus according to claim 11 or 16, wherein the surface of said photosensitive body contains conductive particles and resin.

18. An electrophotography apparatus according to claim 17, wherein said conductive particles are metal oxide.

19. An electrophotography apparatus according to claim 16, wherein said lubricating material is fluoro polymer, silicone polymer, fluoro oligomer or silicone oligomer.

20. An electrophotography apparatus according to claim 16, wherein said lubricating material is polymer or copolymer containing one or more materials selected from tetraluoroethylene, hexafluorepropylene, trifluoroethylene, chlorotrifluoroethylene, vinylidene fluoride, vinyl fluoride and perfluoro olkyl vinyl ether.

21. An electrophotography apparatus according to claim 11, wherein said photosensitive body has a surface layer which contains 5 to 60 wt % of lubricating material in its total weight.

22. An electrophotography apparatus according to claim 16 or 21, wherein said lubricating material is particles having a mean diameter of 0.005 to 0.3 μm.

23. An electrophotography apparatus according to claim 11, wherein said photosensitive body has a surface layer having a resistance of $1\times10^{9}$ to $1\times10^{14}$ Ωm.

* * * * *

UNITED STATES PATENT AND TRADEMARK OFFICE

CERTIFICATE OF CORRECTION

PATENT NO. : 5,708,932

DATED : January 13, 1998

INVENTOR(S) : Hideyuki Yano, et al.

It is certified that error appears in the above-identified patent and that said Letters Patent is hereby corrected as shown below:

COLUMN 2

Line 3, "not,be" should read --not be--;
Line 26, "insularlye" should read --insulative--; and
Line 53, "the," should read --the--.

COLUMN 3

Line 17, "insularlye" should read --insulative--.

COLUMN 8

Line 28, "coupling" should read --or coupling--; and
Line 38, "μm." should read --μm).--.

COLUMN 9

Line 16, "bellow." should read --below--.

COLUMN 12

Line 58, "filament" should read --filaments--.

UNITED STATES PATENT AND TRADEMARK OFFICE

CERTIFICATE OF CORRECTION

PATENT NO. : 5,708,932

DATED : January 13, 1998

INVENTOR(S) : Hideyuki Yano, et al.

It is certified that error appears in the above-identified patent and that said Letters Patent is hereby corrected as shown below:

COLUMN 13

Line 33, "increase" should read --increases--.

COLUMN 15

Line 26, "part" should read --part is--; and
Line 30, "non-formity" should read --non-uniformity--.

COLUMN 16

Line 43 "ltd." should read --Ltd.--.

COLUMN 18

Line 12, "image" should read --images--; and
Line 28, "Stapnation" should read --Stagnation--.

COLUMN 19

Line 23, "insularlye" should read --insulative--;
Line 41, "body," should read --body--;
Line 50, "insularlye" should read --insulative--; and
Line 65, "come" should read --come into--.

UNITED STATES PATENT AND TRADEMARK OFFICE

CERTIFICATE OF CORRECTION

PATENT NO. : 5,708,932

DATED : January 13, 1998

INVENTOR(S) : Hideyuki Yano, et al.

It is certified that error appears in the above-identified patent and that said Letters Patent is hereby corrected as shown below:

COLUMN 20

Line 17, "limit" should read --limit upon--; and
Line 30, "not used" should read --not be used--.

COLUMN 21

Line 12, "sleeve." should read --sleeve--;
Line 13, "When" should read --when--;
Line 20, "(T;" should read --(T:-- and "D;" should read --D:--;
Line 55, "is the" should read --in the--; and
Line 64, "apparatus. Now" should start a new paragraph after "apparatus."

COLUMN 22

Line 9, "periferal" should read --peripheral--.

COLUMN 23

Line 44, "tonnet" should read --toner--.

COLUMN 24

Line 28, "(manufactured" should read --(manufactured by--.

UNITED STATES PATENT AND TRADEMARK OFFICE

CERTIFICATE OF CORRECTION

PATENT NO. : 5,708,932

DATED : January 13, 1998

INVENTOR(S) : Hideyuki Yano, et al.

It is certified that error appears in the above-identified patent and that said Letters Patent is hereby corrected as shown below:

COLUMN 25

Line 21, "slip" should read --slips--;
Line 28, "charge" should read --charged--;
Line 30, "not" should read --not be--; and
Line 39, "the" (second occurrence) should read --if the--.

Signed and Sealed this

Fifteenth Day of September, 1998

*Attest:*

Bruce Lehman

BRUCE LEHMAN

*Attesting Officer*

*Commissioner of Patents and Trademarks*